US007442085B2

(12) United States Patent
Fuerst et al.

(10) Patent No.: US 7,442,085 B2
(45) Date of Patent: Oct. 28, 2008

(54) FILTER CONNECTOR

(75) Inventors: Robert M. Fuerst, Bloomfield, MI (US); Duane M. Fenci, Countryside, IL (US); Russel L. Mackowiak, Wheaton, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/776,398

(22) Filed: Jul. 11, 2007

(65) Prior Publication Data

US 2008/0020645 A1 Jan. 24, 2008

Related U.S. Application Data

(63) Continuation-in-part of application No. 11/035,525, filed on Jan. 14, 2005, now Pat. No. 7,361,055.

(51) Int. Cl.
*H01R 13/66* (2006.01)

(52) U.S. Cl. ..... 439/620.09; 439/676

(58) Field of Classification Search . 439/620.05–620.1, 439/676, 941; 333/181–185
See application file for complete search history.

(56) References Cited

U.S. PATENT DOCUMENTS 4,371,226 A 2/1983 Brancaleone
4,376,922 A 3/1983 Muzslay
4,401,355 A 8/1983 Young
4,410,355 A 10/1983 Feichtner et al.
4,500,159 A 2/1985 Briones et al.
4,690,479 A 9/1987 Hollyday et al.
4,782,310 A 11/1988 Saburi et al.
4,820,174 A 4/1989 Farrar et al.
4,929,196 A 5/1990 Ponn et al.
5,102,354 A 4/1992 Crane et al.
5,152,699 A * 10/1992 Pfeifer ..... 439/620.16
5,213,522 A * 5/1993 Kojima ..... 439/620.07
5,246,389 A * 9/1993 Briones ..... 439/620.1
5,286,221 A 2/1994 Fencl et al.
5,415,569 A 5/1995 Colleran et al.
5,509,825 A 4/1996 Reider et al.
5,539,194 A 7/1996 Miller et al.
5,541,398 A 7/1996 Hanson
5,562,498 A 10/1996 Brandenburg et al.
5,580,280 A * 12/1996 Minich et al. ..... 439/620.22
5,586,912 A * 12/1996 Eslampour et al. ..... 439/620.22
5,599,208 A 2/1997 Ward
5,621,199 A 4/1997 Calari et al.
5,624,277 A 4/1997 Ward
5,630,734 A 5/1997 Phillips, Jr.
5,647,768 A 7/1997 Messuri et al.
5,747,786 A 5/1998 Cargin, Jr. et al.
5,887,324 A 3/1999 Wu (Continued)

FOREIGN PATENT DOCUMENTS

JP 2001-155120 A 6/2001

(Continued)

*Primary Examiner*—James Harvey
(74) *Attorney, Agent, or Firm*—Larry I. Golden

(57) ABSTRACT

A filter connector such as one suitable for suppressing electromagnetic interference, radio frequency interference or both is provided according to an assembly approach that reduces cost. Included is a unitary spring plate that overlies the plug portion of the filter connector and biases the filter components up against the terminals of the connector.

17 Claims, 15 Drawing Sheets

U.S. PATENT DOCUMENTS

| | | | | |
|---|---|---|---|---|
| 5,978,655 | A | 11/1999 | Ohura et al. | |
| 6,080,020 | A | 6/2000 | Grabbe | |
| 6,407,911 | B1 | 6/2002 | Spence et al. | |
| 6,415,978 | B1 | 7/2002 | McAllister | |
| 6,421,234 | B1 | 7/2002 | Ricks et al. | |
| 6,581,837 | B1 | 6/2003 | Hattersley | |
| 6,672,512 | B2 | 1/2004 | Bridgelall | |
| 6,677,852 | B1 | 1/2004 | Landt | |
| 6,732,933 | B2 | 5/2004 | Waxelbaum | |
| 6,832,729 | B1 | 12/2004 | Perry et al. | |
| 6,895,419 | B1 | 5/2005 | Cargin, Jr. et al. | |
| 6,946,950 | B1 | 9/2005 | Ueno et al. | |
| 7,250,845 | B2 | 7/2007 | Young | |
| 2002/0033418 | A1 | 3/2002 | Knowles et al. | |
| 2002/0170969 | A1 | 11/2002 | Bridgelall | |
| 2004/0046031 | A1 | 3/2004 | Knowles et al. | |
| 2005/0082371 | A1 | 4/2005 | Schmidt et al. | |
| 2005/0087603 | A1 | 4/2005 | Koenck et al. | |
| 2005/0121523 | A1 | 6/2005 | Schmidt et al. | |
| 2005/0140507 | A1 | 6/2005 | Nam et al. | |
| 2005/0156040 | A1* | 7/2005 | Young et al. | 235/439 |
| 2006/0157401 | A1 | 7/2006 | Fuerst | |
| 2006/0160425 | A1 | 7/2006 | Fuerst | |
| 2008/0020645 | A1* | 1/2008 | Fuerst et al. | 439/620.1 |

FOREIGN PATENT DOCUMENTS

| | | | |
|---|---|---|---|
| WO | WO/02/073512 | A1 | 9/2002 |

* cited by examiner

FIG.14
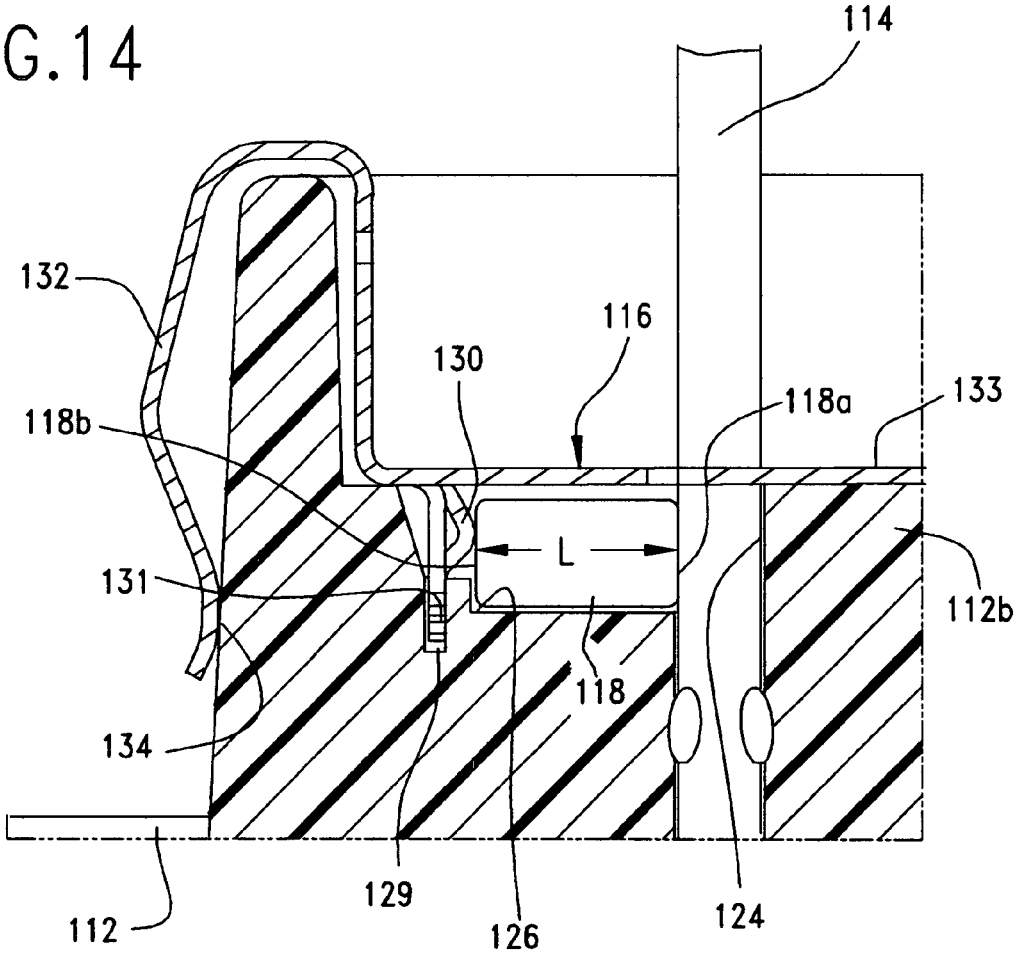
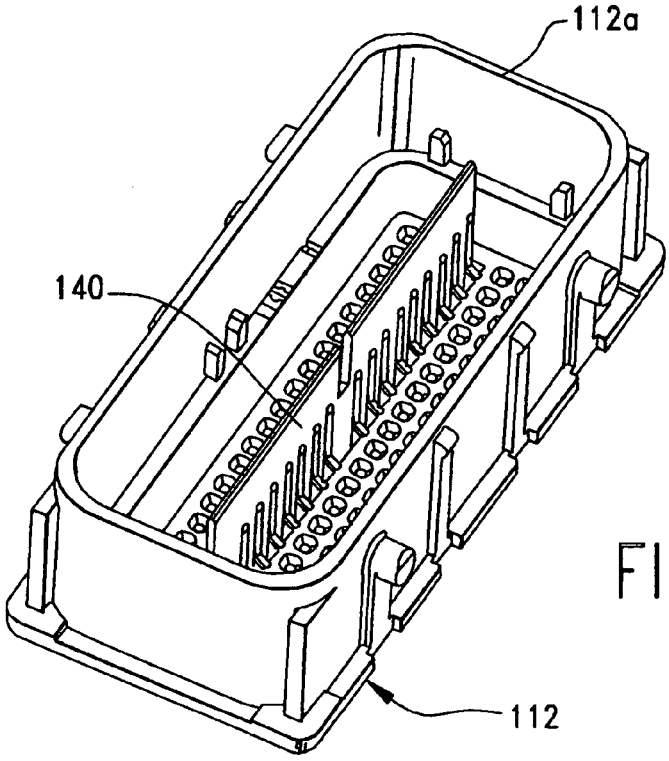
FIG.15

FIG.16
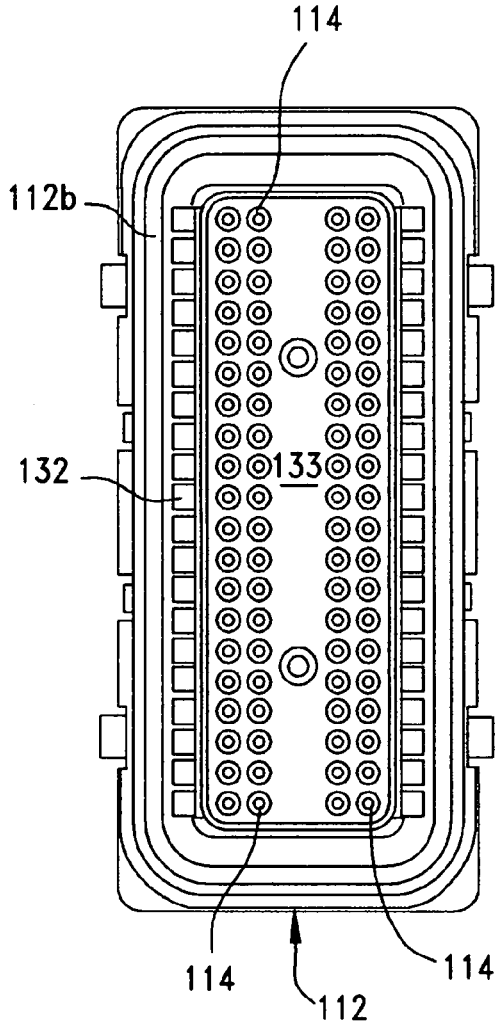
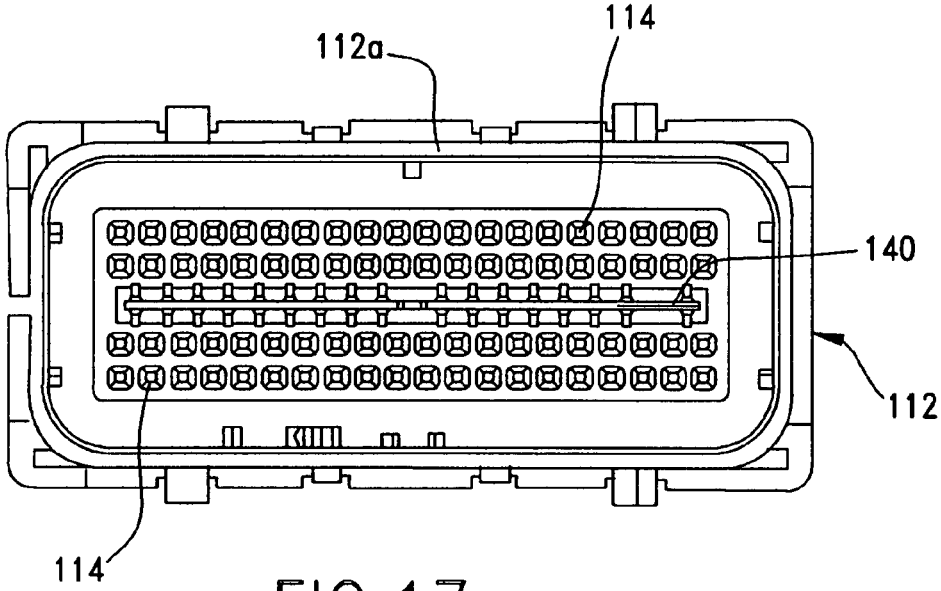
FIG.17

FIG.28
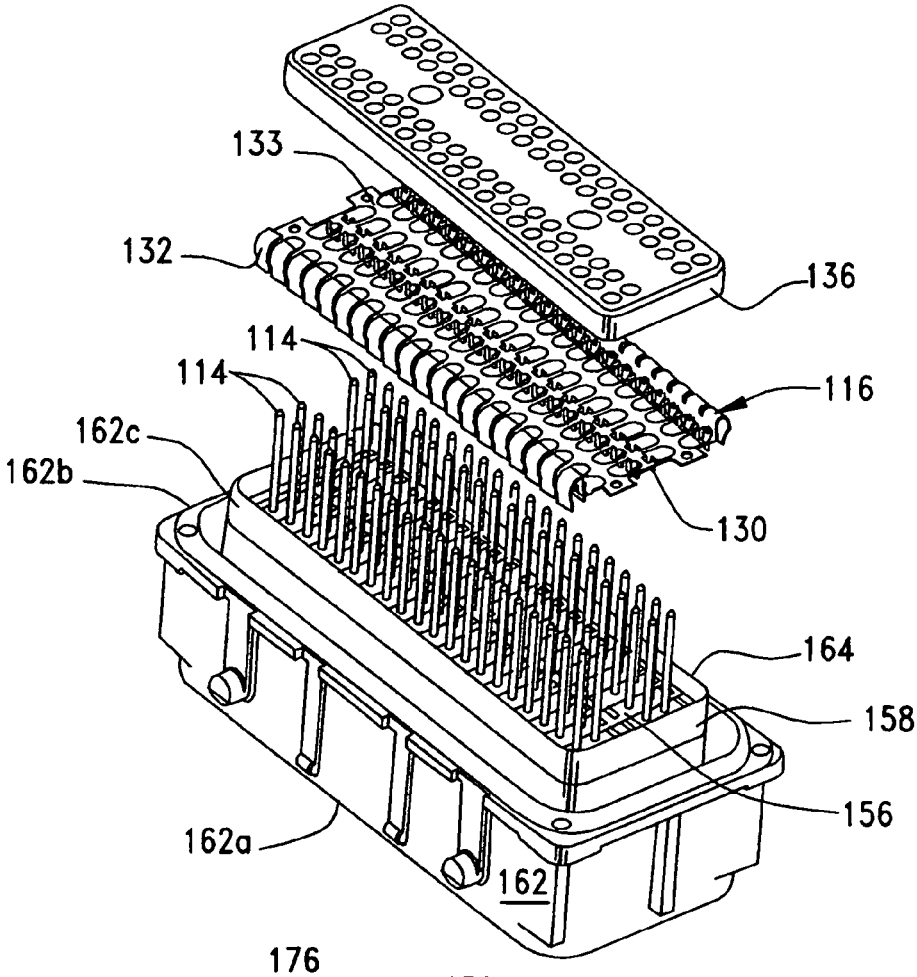
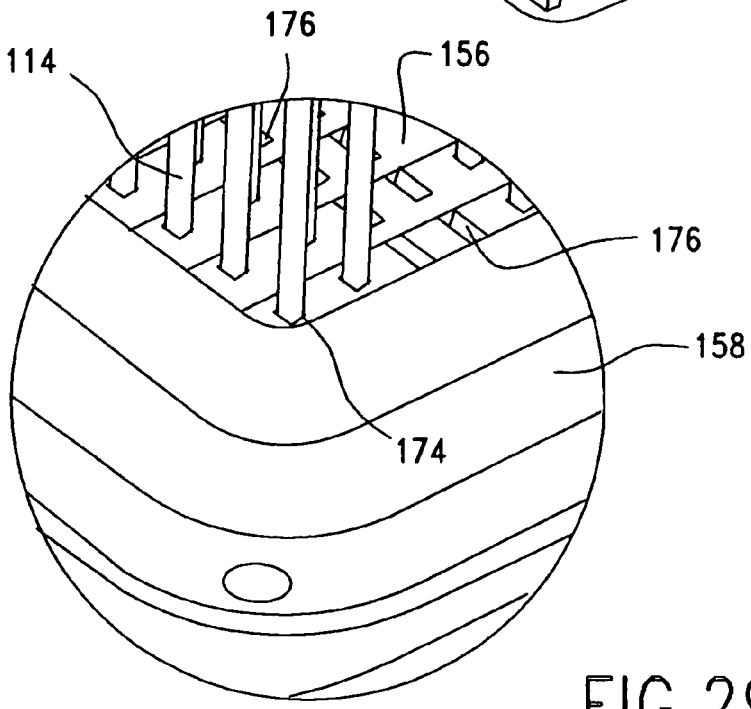
FIG.29

FILTER CONNECTOR

CROSS-REFERENCE TO RELATED APPLICATIONS

This is a continuation-in-part of application Ser. No. 11/035,523, filed Jan. 14, 2005, hereby incorporated by reference hereinto.

BACKGROUND OF THE INVENTION

This invention generally relates to the art of electrical connectors and, particularly, to a filter connector which mounts a plurality of electronic components, such as capacitors or the like. The invention also relates to a method of fabricating the filter connector. The filter connector can have modular characteristics.

There are a variety of electrical connectors which are termed "filter" connectors, in that an electronic component, such as a capacitor, is coupled between the terminals of the connector and a ground plate or shorting bar normally mounted to a face of a dielectric housing of the connector. The filters are used to suppress electromagnetic interference and radio frequency interference entering the connector system.

One of the problems with such filter connectors simply is their cost. Normally, a ground plate is fabricated of stamped and formed conductive metal material and must be mounted separately to the dielectric housing of the connector. Terminals then are mounted in the connector housing. The filter capacitors then must be coupled between the terminals and the ground plate or shorting bar. These steps are time consuming and require assembly tooling, all of which adds considerably to the cost of the connectors. In a mass production environment, reliability and performance are desired. Typically, the terminals are mounted or inserted into a connector housing in one direction, the capacitors are mounted or inserted into the housing in a different direction, and the ground plate or shorting bar is mounted or assembled in the same or different direction. All of these assembly operations require relatively expensive assembly tooling.

Some prior approaches use capacitor arrays, sometimes referred to as monolithic capacitors, in providing filtering functions within connectors. Examples of approaches in this regard include Brancaleone U.S. Pat. No. 4,371,226 and Reider et al. U.S. Pat. No. 5,509,825. While recognized by Brancaleone as a deficiency, the capacitor array approach is compounded by a shield design having large openings that allow EMI/RFI to pass through the assembly. Also, compared with the relatively few components according to the present invention, Brancaleone has additional parts, leading to increased assembly time and cost. In addition to the teaching to use capacitor arrays, Reider requires a "zebra strip" to provide compliance between the capacitor and the pins to compensate for the capacitor array being planar while the pins are not always in the same exact plane. The zebra strip of Reider has the negative of adding inductance and resistance to the filter circuit and additional cost.

Ward U.S. Pat. No. 5,624,277 shows a stamped and formed cantilever spring having spring fingers. The cantilever spring establishes a connection between the capacitors and the contact terminals. This arrangement shows open ends that do not provide adequate EMI/RFI transmission. Farrar et al. U.S. Pat. No. 4,820,174 shows a ground plate that includes a plurality of spring finger openings for receiving a tubular filtered contact assembly. Mounting of this ground plate is facilitated by integral spring fingers that engage the conductive shell of this connector assembly with filtered inserts. This approach requires a relatively complex filter contact assembly.

Through the inventive efforts of the present disclosure there is a reduction in the number of components, and these reduced number of components achieve grounding and shielding while providing secure electrical contact between the input and output side of the connector and the shielding components positioned there along. This inventive approach reduces cost and complexity and reduces EMI/RFI emissions through the header of the filter connector.

In some circumstances it can be desirable to provide a filter connector in which the terminals and filters/capacitors are mounted in modules and assembled in a larger outer connector housing. By such a modular approach the outer housing of the filter connector can be molded in different sizes to customize the connector to meet a need for a specific size and/or shape. These different numbers of modules are oriented to comply with the customized design. This is considerably less complicated and less expensive than customizing an entire connector for different numbers of terminals and filters.

SUMMARY OF THE INVENTION

An overall aspect or object of the invention is to provide new and improved filter connectors of the character described, along with a method of fabricating the filter connectors.

In an exemplary embodiment of the invention, the filter connector includes a dielectric housing having a mounting face. At least one row of terminal-receiving passages are formed in the housing through the mounting face. A row of filter-receiving pockets are formed in the housing through the mounting face respectively in alignment with the passages, and with one side of each pocket communicating with its respective passage. A plurality of terminals are mounted through the passages. A plurality of filters are positioned or inserted into the pockets through the mounting face, with one side of the filters respectively engageable with the terminals. A unitary spring member or common spring plate is positioned over the filter-receiving pockets and provides engagement with respective opposite sides of the plurality of filters.

According to an aspect or embodiment, the unitary spring member or common spring plate, biases the respective filters against the terminals. As disclosed herein, the unitary spring member is stamped and formed of sheet metal material and includes integral leaf spring portions engageable with the filters. Therefore, the filters can be easily mounted fairly loosely into their respective passages, and the leaf spring portions are effective to tighten the assembly.

According to other aspects or embodiments, the terminals comprise terminal pins and the filters comprise capacitors. The housing has a mating face and a terminating face, and the mounting face comprises the terminating face of the connector. In the preferred embodiment, a plurality of generally parallel rows of the terminal-receiving passages are formed in the housing along with a corresponding plurality of generally parallel rows of the filter-receiving pockets. The unitary spring member or common spring plate essentially spans the mounting face in order to greatly reduce EFI/RMI emissions through the header.

In another exemplary embodiment of the invention, the filter connector includes an outer housing having a cavity. A plurality of inner housing modules are positionable in the cavity in a side-by-side array. At least one terminal is mounted in each housing module to define at least one row of terminals along the cavity. At least one filter is mounted in each housing module electrically coupled to each terminal to define at least one row of filters. A common spring plate or unitary spring member spans the plurality of housing modules and is electrically coupled to the plurality of filters of the modules.

According to another embodiment or aspect, the common spring plate or unitary spring member biases the filters against the terminals. Biasing members are integral with the unitary spring member or common spring plate, which can be stamped and formed of sheet metal material, with the biasing members comprising integral leaf spring portions of the common spring plate engageable with the filters.

According to another aspect or embodiment when a modular approach is practiced, adjacent housing modules can rest within a shell shaped and sized according to the connector perimeter to be provided. The modules can have formations that are engageable with each other to hold the modules in their side-by-side array. These formations can comprise integral interconnecting projections and indentations between adjacent housing modules, such as interengageable dovetail connections on the modules.

According to another aspect or embodiment, as disclosed herein, the terminals comprise terminal pins, and the filters comprise capacitors. A plurality of the terminal pins is mounted to define a plurality of generally parallel rows of terminals along the cavity. A corresponding plurality of generally parallel rows of the capacitors are respectively electrically coupled to the terminal pins. The common spring plate or unitary spring member is electrically coupled to the capacitors in each row thereof.

Other aspects, embodiments, objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects, aspects, features and embodiments and the advantages thereof may be best understood by reference to the following description taken in conjunction with the accompanying drawings, in which like reference numerals identify like elements in the figures and in which:

FIG. 14 is a detailed view of a portion of FIG. 13;

FIG. 15 is a perspective view of an embodiment of the dielectric housing, viewed from the mating face side;

FIG. 16 is a plan view of the housing of FIG. 15, showing the mounting face side;

FIG. 17 is a plan view of the housing of FIG. 15, showing the mating face side;

FIG. 28 is an exploded perspective view of an embodiment having a modular approach incorporating a unitary spring member;

FIG. 29 is an enlarged detail perspective view of a corner portion of FIG. 28.

DETAILED DESCRIPTION OF EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 2:
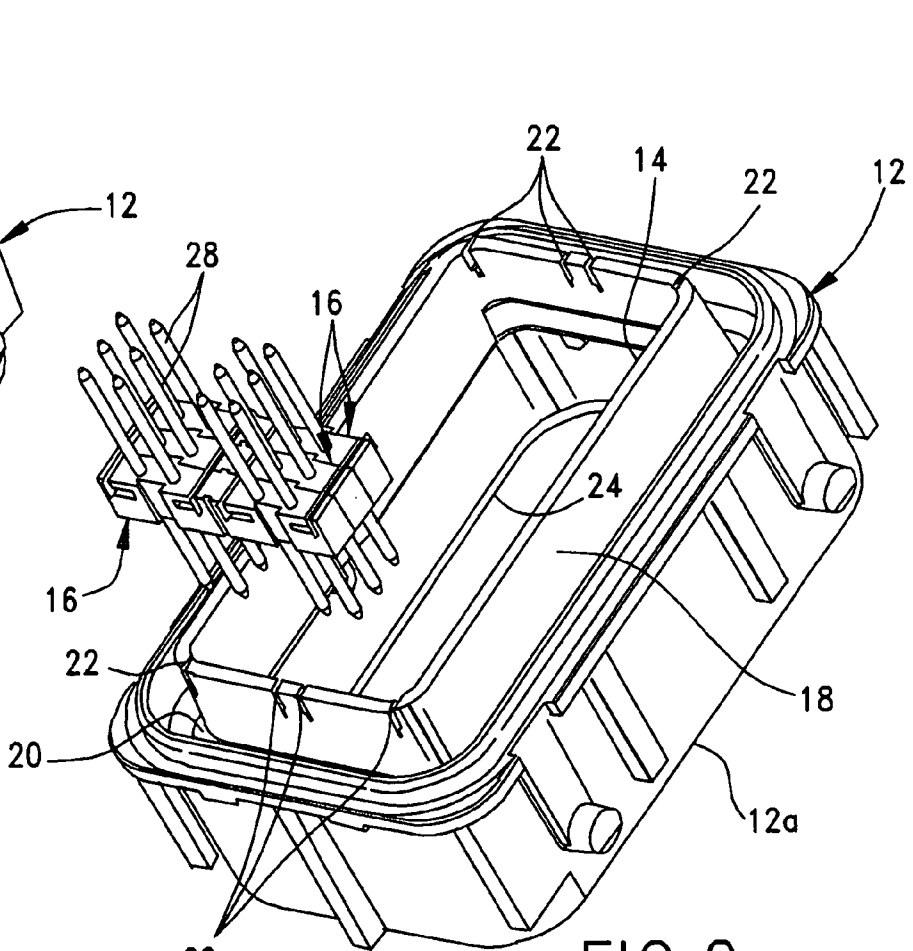
FIG. 2 is a perspective view of the outer connector housing of FIG. 1, along with a cluster of three inner housing modules for illustration purposes.
Figure 1:
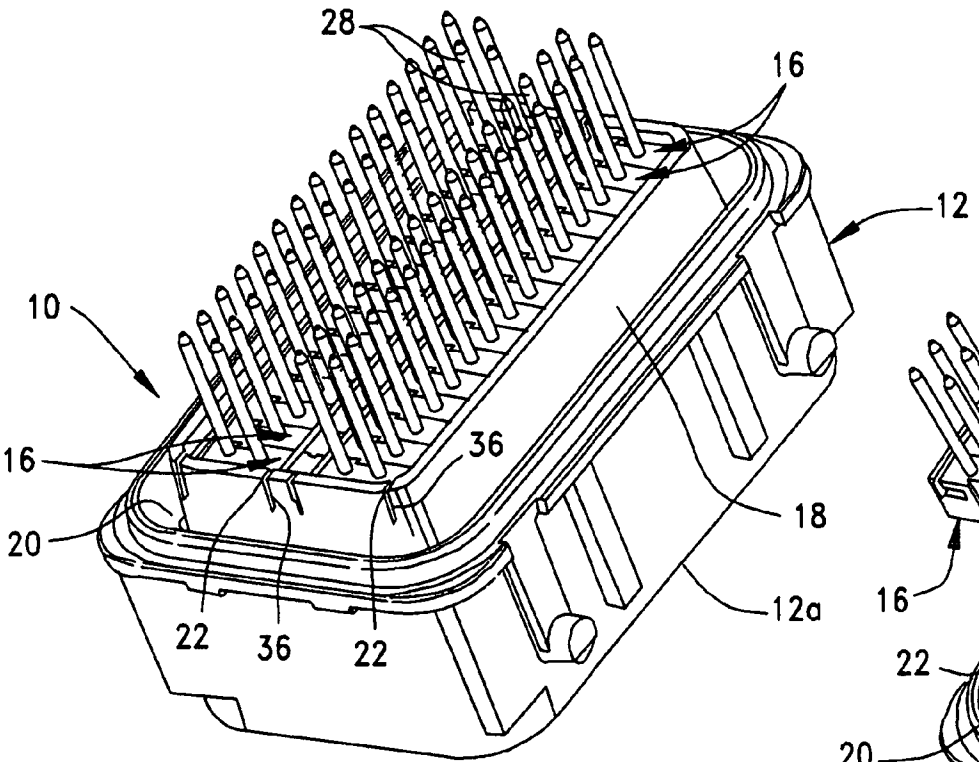
FIG. 1 is a perspective view of a modular filter connector according to an embodiment.

Referring to the drawings in greater detail, and first to FIGS. 1 and 2, a modular filter connector is shown, generally designated 10, which includes an outer connector housing, generally designated 12. The outer housing defines a cavity 14 which receives a plurality of inner housing modules, generally designated 16, which are positionable within the cavity in a side-by-side array as seen in FIG. 1.

More particularly, in this particular illustrated arrangement, housing 12 is generally rectangular and includes a generally rectangular plug portion which surrounds and defines cavity 14. A peripheral groove 20 surrounds plug portion 18 for receiving a metal casing. With this arrangement, four slots 22 are formed in the outer edge of plug portion 18 at each opposite end thereof as best seen in FIG. 2, for receiving ends of four shorting bars as will be described hereinafter. Housing 12 has a mating end 12*a* which defines a receptacle 24 (FIG. 2) for receiving a complementary mating connecting device or second connector.

Figure 3:
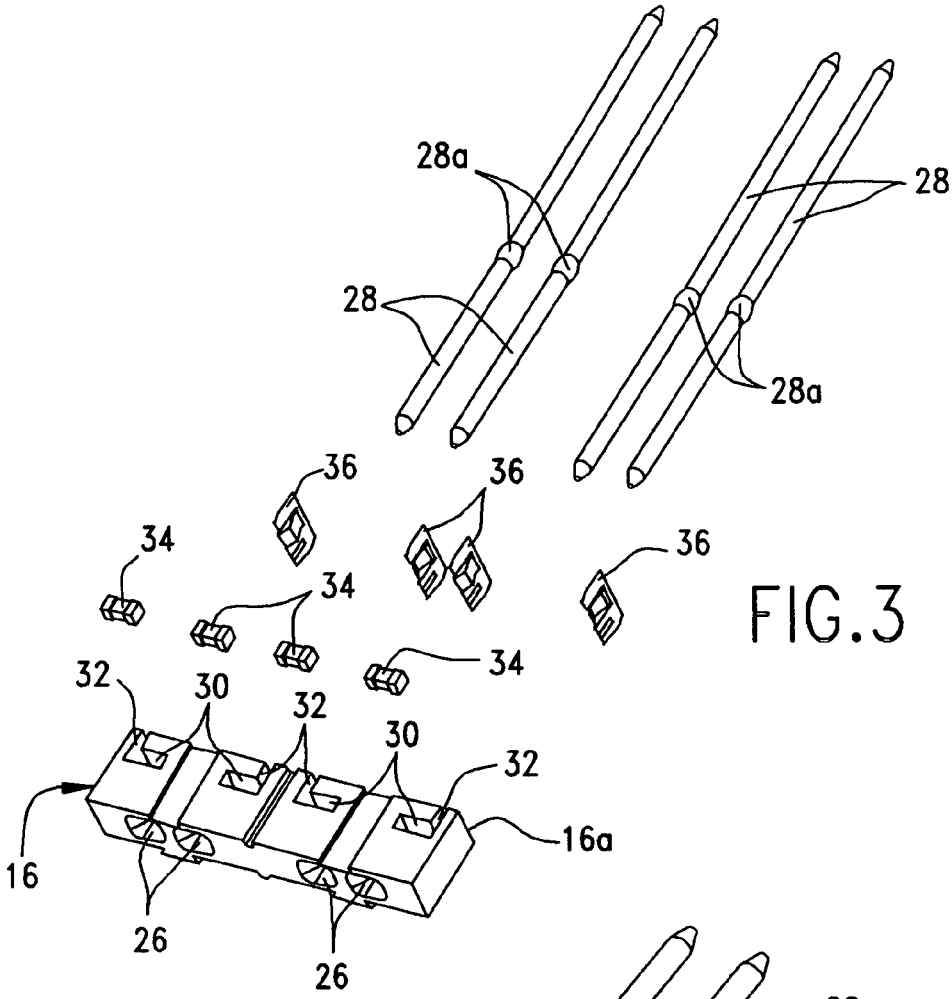
FIG. 3 is an exploded perspective view of one of the inner housing modules illustrated in FIG. 2.
Figure 4:
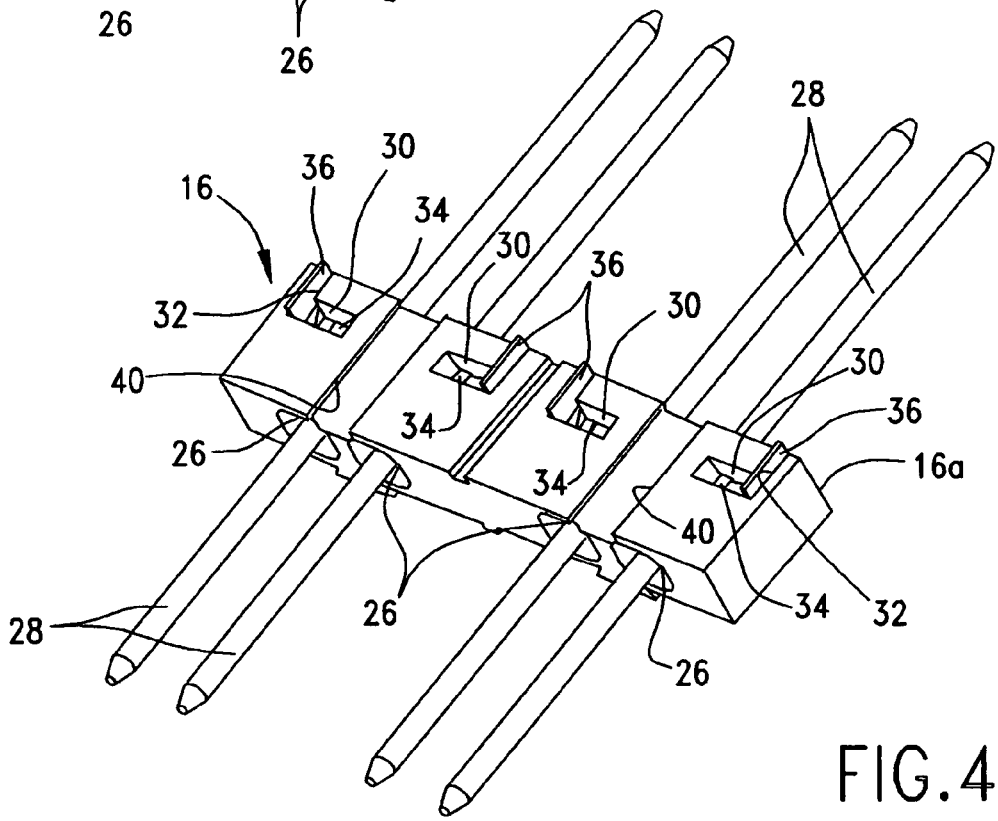
FIG. 4 is a perspective view of one of the inner housing modules illustrated in FIG. 2 in assembled condition.

Referring to FIGS. 3 and 4 in conjunction with FIGS. 1 and 2, each housing module 16 includes four terminal-receiving through passages 26 for receiving four terminal pins 28. The terminal pins are inserted through the housing module as seen in FIG. 4. Enlarged fixing sections 28*a* (FIG. 3) securely fix the terminal pins within passages 26. Each housing module is a one-piece structure that may be molded of dielectric plastic material.

Each inner housing module 16 also includes four pockets 30 formed in one side of the housing module, along with four slots 32 in a top face 16*a* of the module. Each pocket 30 communicates at one end thereof with a respective terminal-receiving passage 26. Each pocket also communicates at an opposite end thereof with a respective slot 32.

Four filters in the form of capacitors 34 are inserted into pockets 30 from the side of each housing module 16. When filly assembled, one end of each capacitor is electrically coupled or engaged with a respective one of the terminal pins 28, and an opposite end of the capacitor is electrically coupled or engaged according to this arrangement with a shorting bar described below.

As seen best in FIG. 1, four common shorting bars span the entire side-by-side array of housing modules 16 in this particular arrangement that mounts the components together using a shorting bar approach. In the depictions of FIGS. 2-4, only longitudinal or lengthwise sections of the shorting bars are shown simply to facilitate the illustration.

Figure 5:
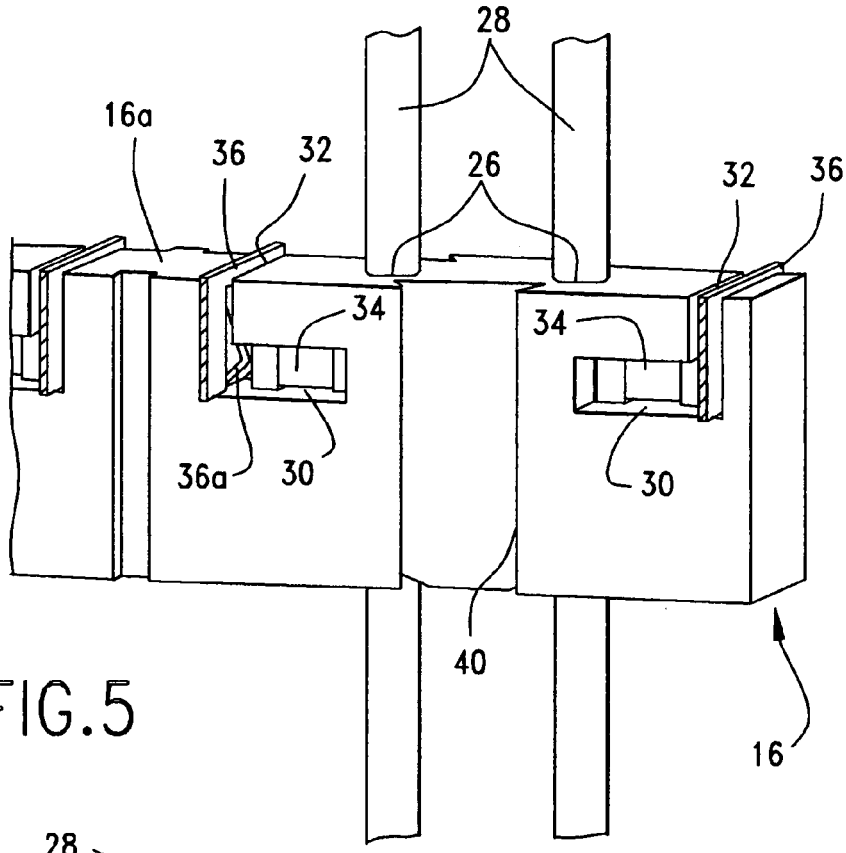
FIG. 5 is a fragmented, enlarged perspective view of the right end of the module illustrated in FIG. 4.
Figure 6:
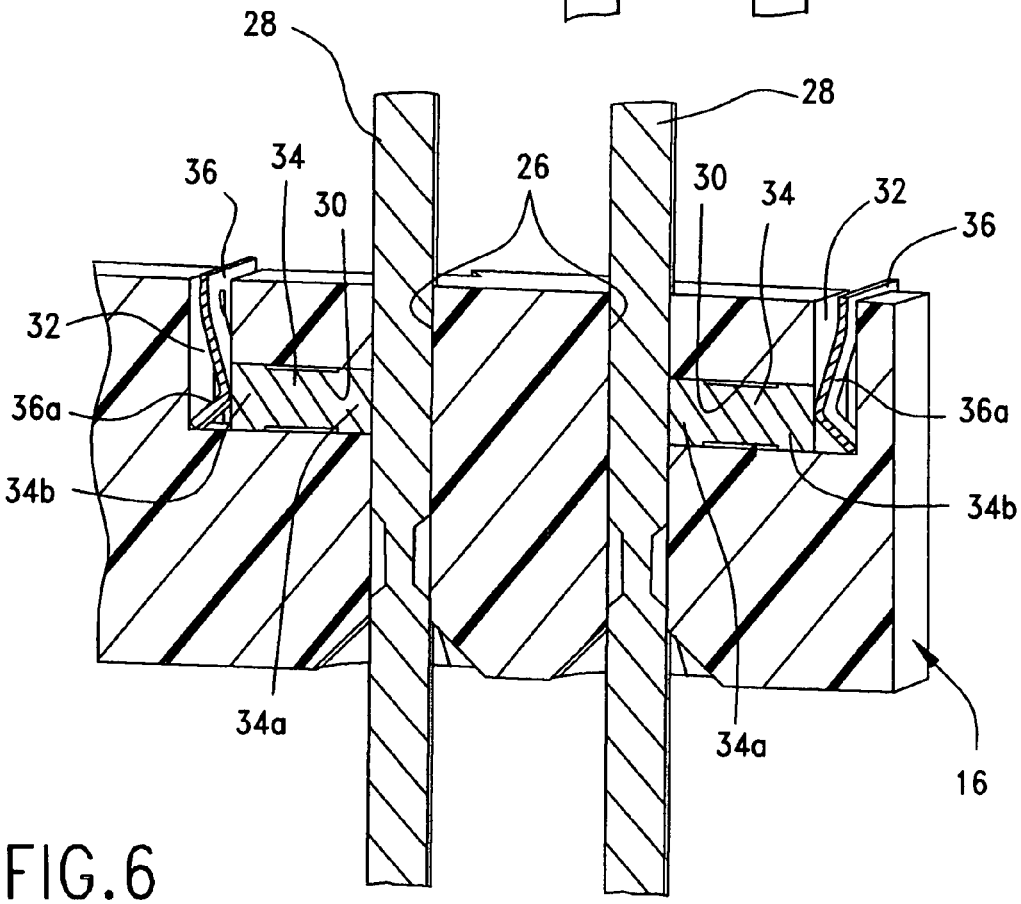
FIG. 6 is a vertical section through the fragmented portion of the module as shown in FIG. 5.

FIGS. 5 and 6 show quite clearly the assembly of one of the inner housing modules 16 with a pair of terminal pins 28, a corresponding pair of capacitors 34 and longitudinal sections of a pair of shorting bars 36 of this approach. The terminal pins have been inserted through terminal-receiving passages 26 in the housing module. Capacitors 34 have been inserted into pockets 30 in the housing module in a direction generally perpendicular to the terminals and terminal-receiving passages. Shorting bars 36 have been inserted into slots 32 in the housing module. It can be seen that one end 34*a* of each capacitor 34 is in engagement with a respective one of the terminal pins 28. An opposite end 34*b* of each capacitor is in engagement with a portion of a respective one of the shorting bars 36 according to this approach.

Generally, biasing means are provided between shorting bars 36 and capacitors 34 to bias the capacitors against terminal pins 28. Specifically, each shorting bar by this approach may be stamped and formed of sheet metal material. As best seen in FIG. 6, an integral leaf spring portion 36*a* is stamped and formed out of each shorting bar 36 for engaging end 34*b* of each capacitor 34. This leaf spring portion biases end 34*a* of the respective capacitor into engagement with the respective terminal pin 28.

In assembly, it is contemplated that pockets 30 for receiving capacitors 34 can be dimensioned to receive the capacitors sufficiently loose to allow for easy assembly of the capacitors into their respective pockets. Then, when shorting bars 36 of this approach are inserted into slots 32, integral leaf spring portions 36*a* are effective to "tighten" the assembly by forcing the capacitors securely against the terminal pins. In other words, the shorting bars, with their leaf spring portions, are effective to hold the assembly in electrical contact.

Figure 7:
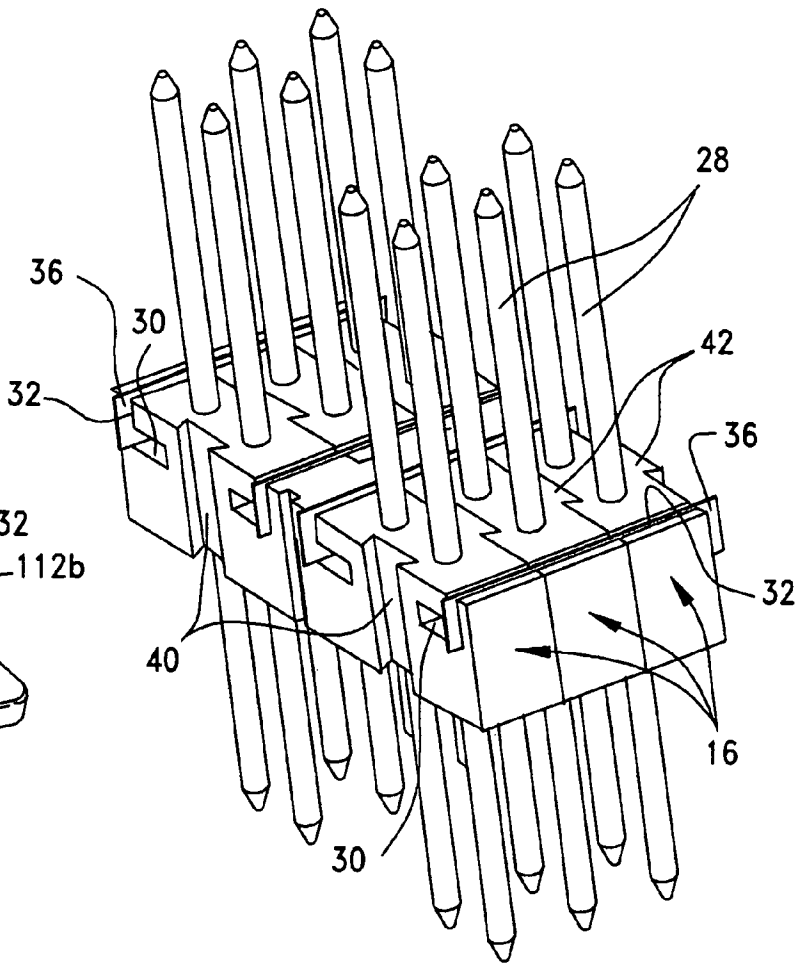
FIG. 7 is a perspective view of a cluster of three modules interconnected in a side-by-side array.

Generally, securing means are provided between adjacent housing modules 16 to hold the modules in their side-by-side array. As disclosed herein, the securing means comprise interengageable dovetail connections which are integral with the housing modules. Referring to FIG. 7, it can be seen that each housing module 16 of this illustrated embodiment according to this approach has a pair of dovetail grooves 40 molded in one side face thereof. A pair of dovetail ribs 42 are formed on the opposite side of each module. Therefore, the modules can be secured together in a side-by-side array as shown in FIG. 7 by interengaging the dovetail-shaped ribs 42 within the dovetail-shaped grooves 40.

In assembly of connectors 10, it first is determined how many housing modules 16 are required within cavity 14 of connector housing 12. Then, each housing module is assembled with its four terminal pins 28 and four capacitors 34. The number of housing modules 16 required to fill cavity 14 then are secured together in a side-by-side array by interengaging the dovetail-shaped grooves 40 and ribs 42. This subassembly of all of the required housing modules then is inserted into cavity 14 of housing 12 as shown in FIG. 1. According to this arrangement, four common shorting bars 36 then are inserted into their respective slots 32 in the housing modules to hold the entire array of modules in a tight assembly, biasing capacitors 34 of the entire array against all of the terminal pins 28. It can be seen that shorting bars 36 have been cut to lengths to extend beyond the end-most housing modules 16 so that the ends of the shorting bars project through slots 22 (see FIG. 2) at opposite ends of plug portion 18 of the housing. The opposite ends of the shorting bars are serrated or somehow sharpened so that they bite into the material of the metal casing that is inserted into peripheral groove 20 of the housing. Therefore, the shorting bars are grounded to the metal casing.

After the connector is fully assembled, a liquid encapsulant is poured into a recessed area 50 (FIG. 1) inside plug portion 18 of the housing. The encapsulant is cured or hardened and seals the entire outer interface of the interengaged housing modules. In addition, the encapsulent secures the ferrite to the housing throughout its life.

With the modular concept of this illustrated approach, it can be understood that connector 10 can be customized for different numbers of terminals (i.e., different densities for the connector). This is accomplished simply by changing the tooling to enlarge or reduce the length of housing 12 and, thereby, the longitudinal size of cavity 14. Changing the length of the outer housing is a relatively simple procedure. Of course, changing the length of the housing and/or cavity, changes the number of modules 16 which are inserted into the cavity. However, the modules themselves are not changed at all. Customizing the connector simply involves different numbers of modules to be inserted into the cavity of connector housing 12. This structural combination and method of fabrication is less complicated and less expensive than if an entire electrical connector, including means for receiving the terminal pins, means for receiving the capacitors and means for receiving the shorting bars, had to be changed for each customized connector. The manufacturing and assembly tooling would have to be changed for a non-modular custom connector.

Although the above description in relation to the drawings describe a connector assembly wherein modules 16 form four rows of terminal pins, along with a corresponding four rows of capacitors and four shorting bars, it should be understood that this specific assembly or connector configuration is an illustration for this modular approach. Different numbers of rows of terminals, rows of capacitors and shorting bars are contemplated and can be easily accommodated. A single row or more than four rows could be used in a connector assembly. Also, a unitary spring member can be provided in a modular arrangement, as described herein.

Figure 8:
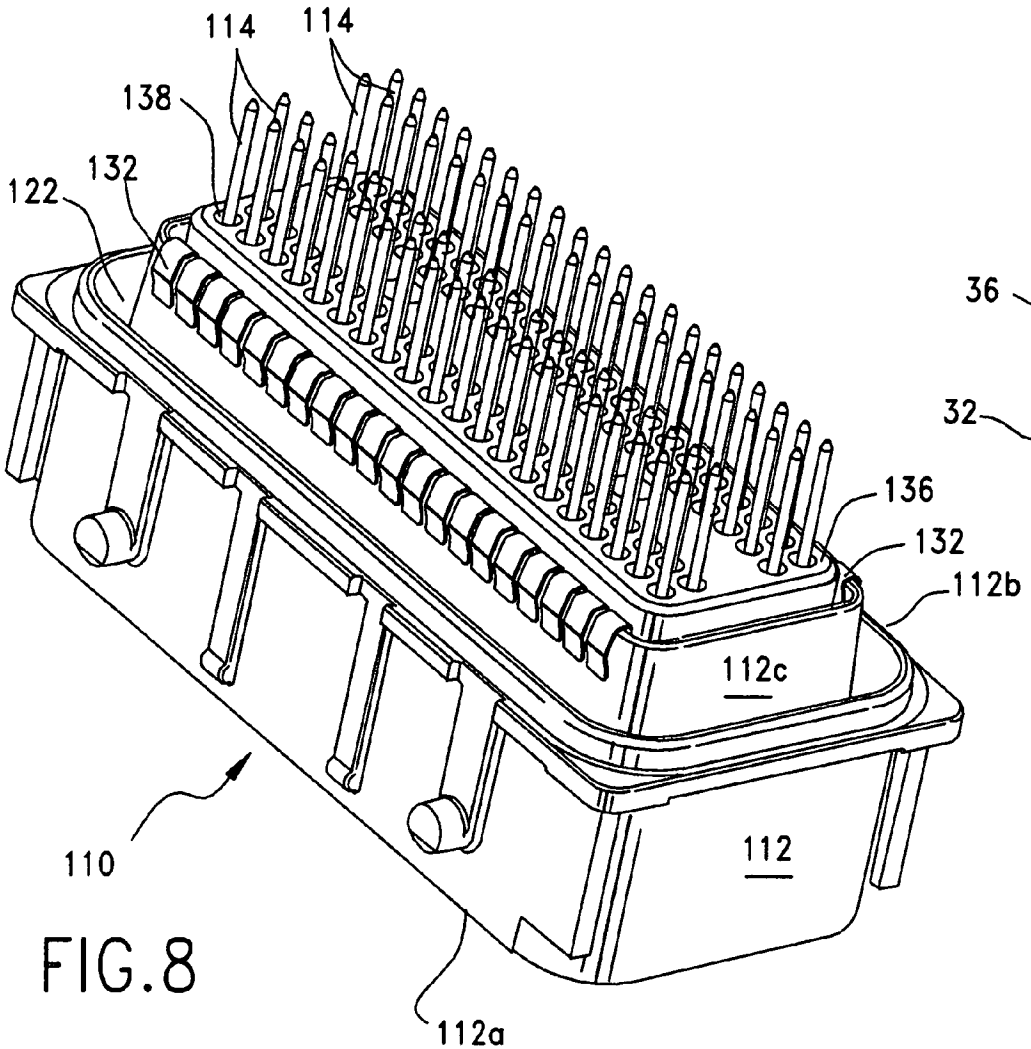
FIG. 8 is a perspective view of a filter connector according to another embodiment.
Figure 9:
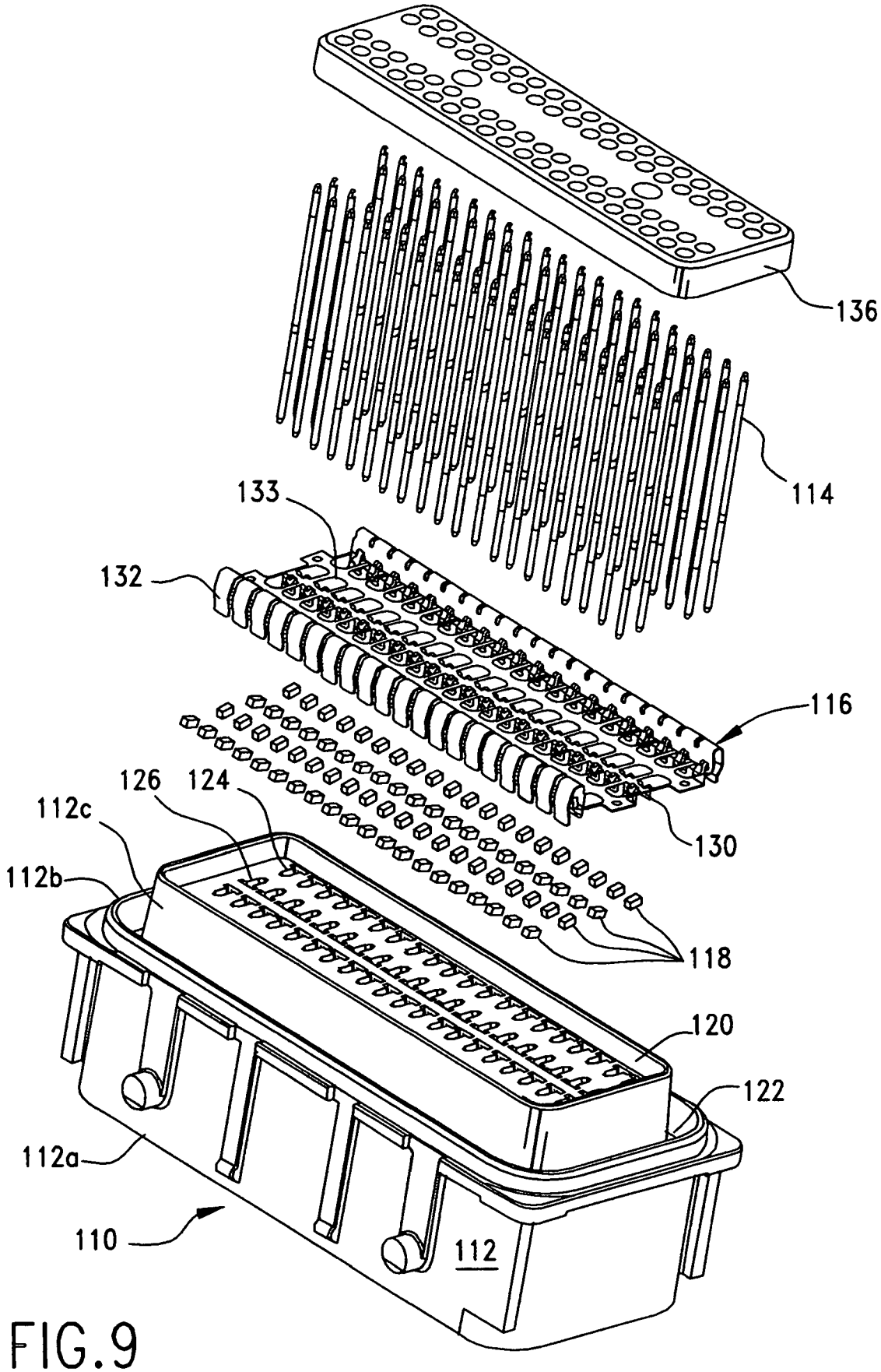
FIG. 9 is an exploded perspective view of the filter connector illustrated in FIG. 8.
Figure 10:
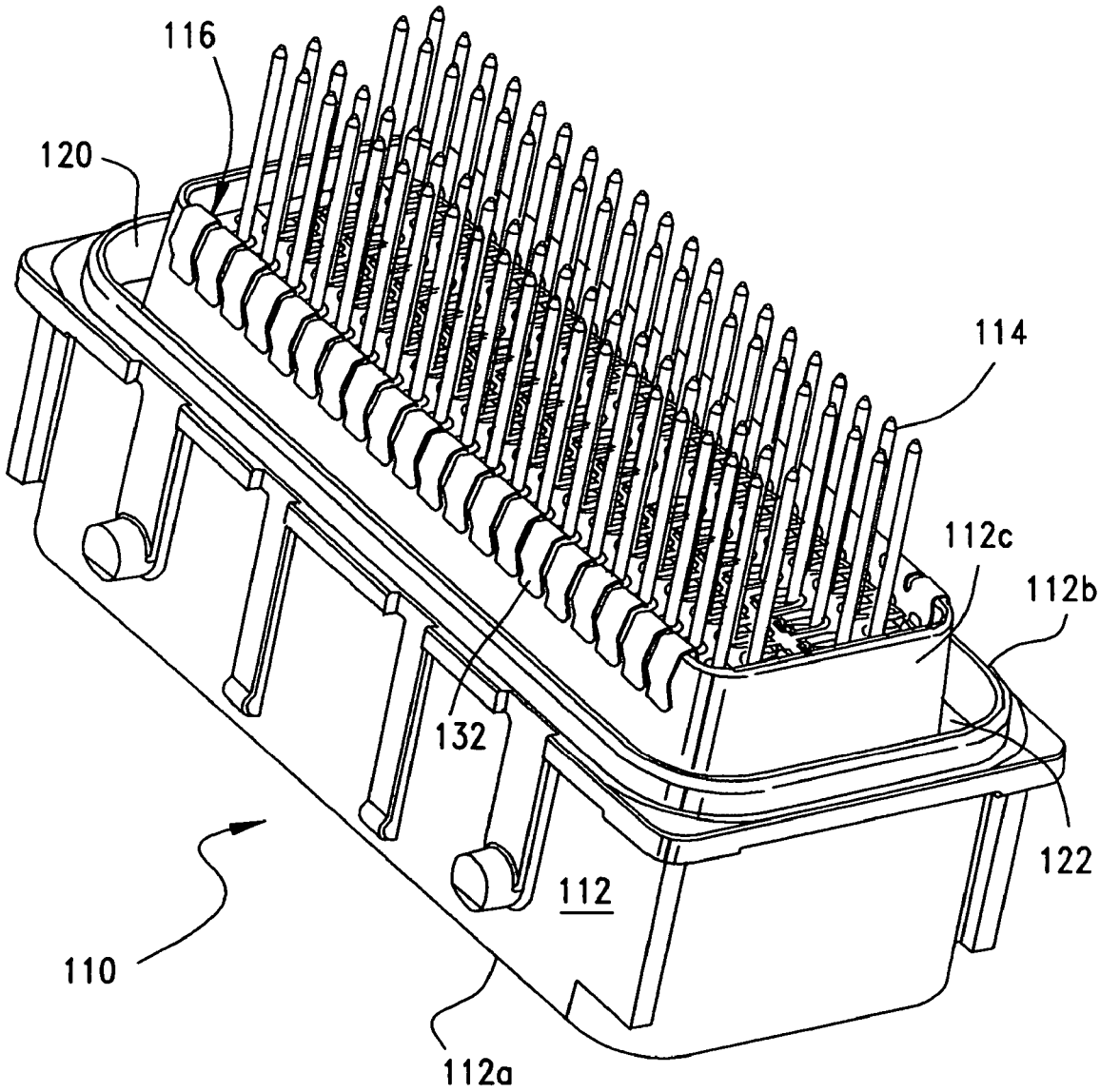
FIG. 10 is a perspective view of the filter connector of FIG. 8, shown with the ferrite omitted for illustrative purposes.
Figure 11:
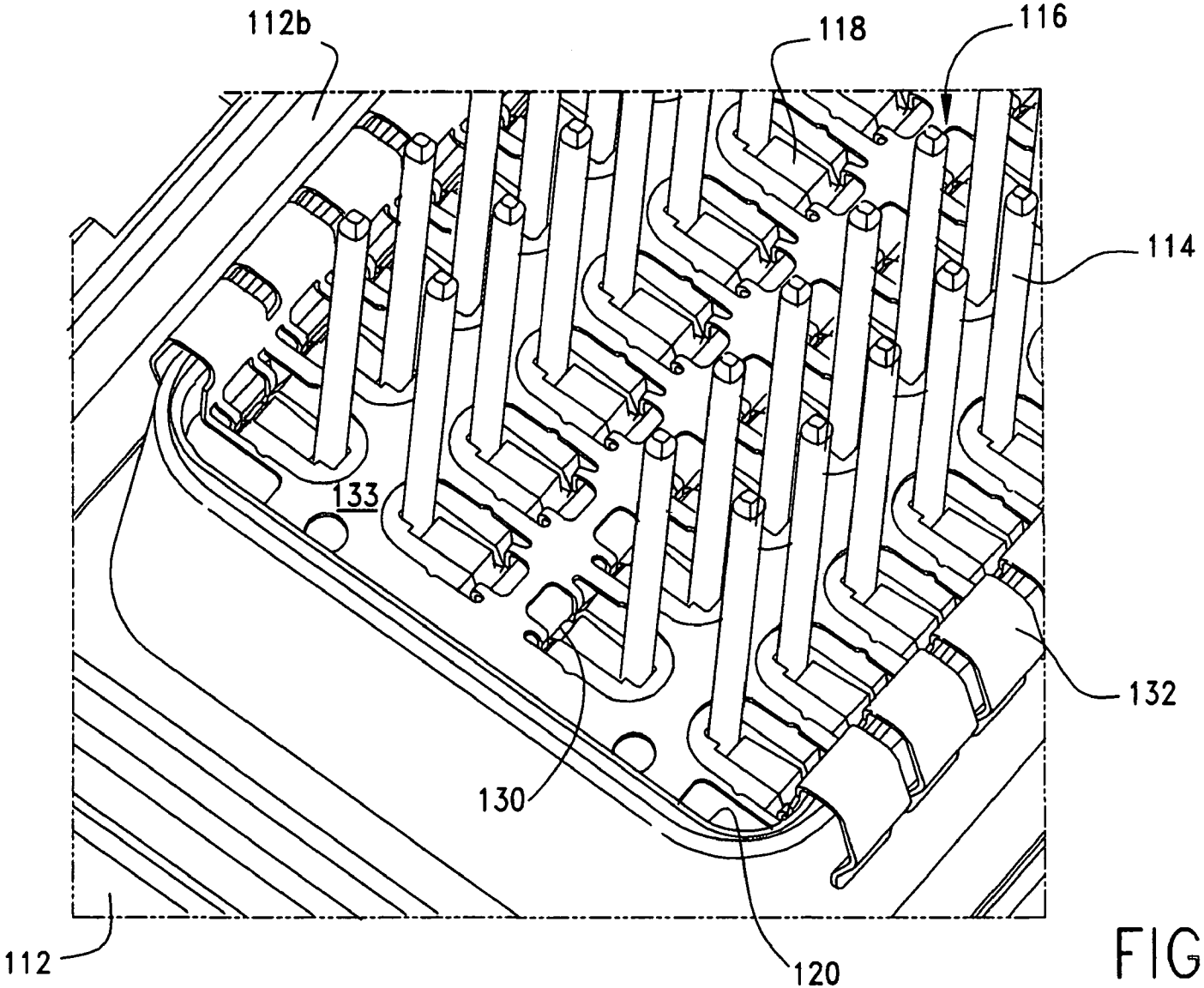
FIG. 11 is a perspective, detailed view of a portion of FIG. 10.
Figure 13:
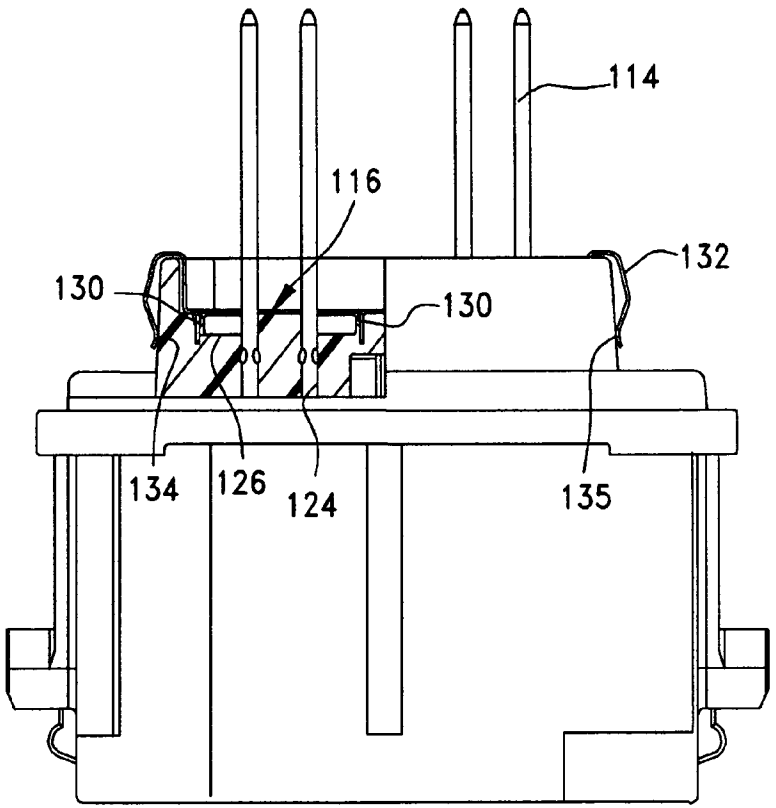
FIG. 13 is a partial transverse cross-sectional view of FIG. 10.
Figure 12:
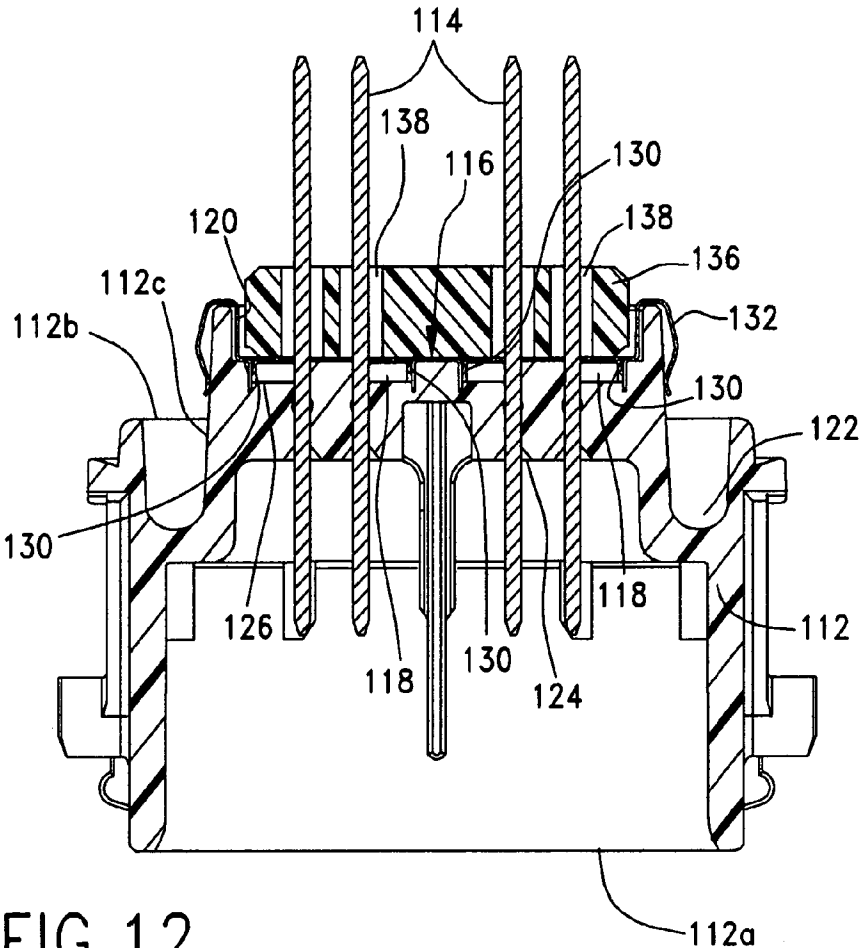
FIG. 12 is a transverse cross-sectional view through the embodiment of FIG. 8.

Referring to the embodiment illustrated on FIGS. 8, 9 and 10, a filtered electrical connector, generally designated 110, includes a dielectric housing, generally designated 112, a plurality of terminals in the form of terminal pins 114, a unitary spring member, generally designated 116, and a plurality of chip components 118 (FIG. 9). Chip components 118 can take the form of filters, capacitors, resistors, jumpers, or other chip components. A suitable capacitor is a multi-layered chip capacitor, for example. In this particular illustrated embodiment, housing 112 of connector 110 receives four rows of terminal pins 114, with twenty pins in each row, with twenty chip components for each row of twenty terminal pins. In the direction orthogonal to these rows in this illustration, there are multiple columns of terminal pins and chip components. Twenty such columns are depicted in FIGS. 8, 9 and 10. Unitary spring member 116 runs the entire length of these rows and columns encompassing eighty chip components and eighty corresponding terminal pins.

Housing 112 of connector 110 may be molded of dielectric material or the like. The housing includes a mating face 112*a* and a terminating face 112*b*. Under this configuration, the terminating face will be considered the mounting face herein and in the claims hereof. The mounting face can be recessed, as at 120, which can receive an encapsulant (not shown) after assembly. Terminal pins 114, and chip components 118 are inserted into the housing typically from the mounting face 112*b* side thereof. The housing has a plug portion 112*c* at the terminating end thereof, and the plug portion typically is surrounded by a peripheral groove 122. A metal casing of the connector (not shown) is assembled into the peripheral groove, and the unitary spring member 116 is grounded to the metal casing and urges the chip components and terminal pins into engagement with each other as will be seen hereinafter.

In this illustrated embodiment, housing 112 has four rows of terminal-receiving passages 124 through mounting face 112*b* thereof. The housing has four rows of chip component-receiving pockets 126 through the mounting face and respectively in alignment with the terminal-receiving passages. Correspondingly, these terminal-receiving passages 124 are in twenty columns, as are the pockets 126.

Further details of the various components will now be described in conjunction with a method of fabricating or assembling connector 110, referring especially to FIG. 9 and to the enlarged depictions of FIGS. 11, 12, 13 and 14. Specifically, terminal pins 114 first can be inserted into passages 124 in housing 112 through the mating face 112*a* or the mounting face 112*b* thereof. The terminals are inserted into the passage fairly tightly, as by a press-fit which assists in securing the terminals in their assembled condition within the passages. Chip components 118 then are inserted or assembled into filter-receiving pockets 126, through mounting face 112*b* of the housing. Typically, the chip components are assembled into the pockets fairly loosely, or at least loose enough to make it quite easy to insert the chip components into their respective sockets. In actual practice, the chip components typically are "gang placed" into their respective pockets, usually one row at a time. The relatively loose fit between the chip components and the pockets facilitates this gang insertion process.

Unitary spring member 116 then is inserted over the mounting face 112*b* of the housing. The unitary spring member typically is manufactured by being stamped and formed of sheet metal material, such as tin-plated steel. The unitary spring member is formed with biasing components. In this embodiment, the biasing components are in the form of a plurality of leaf springs 130 which respectively engage chip components 118 to bias each respective chip component against its corresponding terminal pin 114. It will be noted that each leaf spring has a tail 131 downwardly depending therefrom. During and after assembly, each downwardly depending tail 131 is closely accommodated by an engagement slot 129 in the dielectric housing. Each engagement slot 129 is sized and shaped such that each leaf spring tail 131 fits tightly into its slot 129, which provides an elegant approach for properly placing the components thus assembled while accommodating variations in sizing, especially of the chip components 118. In essence, the leaf springs 130 are effective to "tighten" the assembly in view of the somewhat loose initial assembly of the chip components into their respective pockets. The injection molded dielectric housing 112 gives the engagement slots 129 close tolerance characteristics. Insertion of each leaf spring tail 131 into its slot 129 effectively imparts those tolerance characteristics to the unitary spring member 116, while flexibility of the leaf springs themselves accommodates less precise tolerances in other components, most notably in the chip components 118.

When finally assembled as shown especially in FIG. 14, one side 118*a* of each chip component 1I 8 is biased by the respective leaf spring 130 toward one side of the respective pocket 126 which communicates with the respective terminal-receiving passage 124. At least one edge clip 132 is positioned on opposing ends of the unitary spring member 116. Each respective leaf spring 130 engages an opposite side 118*b* of the chip component in view of the fact that the opposite side of the respective pocket 126 accommodates the respective leaf spring 130 that depends from the unitary spring member 116 of this embodiment into the pocket 126.

With further reference to the unitary spring member or common spring plate 116, same provides in a single unit a plurality of essential components, thereby reducing cost and complexity. This single unit spring component also improves performance, including creating a ground shield over the entire header opening, that is the entire area within the confines of the multiple edge clips 132. Unitary spring member 116 effectively fills the area of the plug portion 112*c* with shield material, thereby greatly reducing EMI/RFI emissions through the header.

The unitary spring member or common spring plate 116 also reduces cost and complexity of manufacture, fabrication and assembly by consolidating four components into the single part. This reduces capital requirements for manufacturing and can reduce skilled labor costs due to ease of alignment and assembly by a single placement of the unitary spring member or common spring plate onto the connector in order to substantially simultaneously provide the desirable biasing action between the plate, the pins and the chip components therebetween while properly placing the respective parts within needed tolerances.

The advantageous biasing action achieved by the unitary spring member 116 and its leaf springs is facilitated by spacing of the unitary spring member components with respect to features of the mounting face 112*b* and its plug portion 112*c*. The edge clips 132 define the outer boundary of the unitary spring member or common spring plate 116. In the illustrated embodiment multiple edge clips 132 define opposing end portions of a plate-like section 133 of spring 116 that covers substantially all of the opening of the plug portion 112*c*. In this illustrated embodiment, twenty columns of two opposing edge clips each are provided.

Spacing between opposing edge clips 132, specifically their respective inset portions 134, 135, when their unitary spring member 116 is assembled onto the outside surface of the plug portion 112*c* is substantially equal to the width between the outside surfaces of the plug portion 112*c* of the housing 112 at the location of engagement between the inset portions 134, 135 and the plug portion 112*c*. This can be seen in FIGS. 12 and 13. Leaf springs 130 are spaced along the plate-like section 133 to provide the biasing force that secures the needed contact between the chip components 118 and their respective terminal pins 114. When assembled, such as shown in FIG. 14, the spacing between the leaf spring 130 under biasing tension and the opposing wall of the terminal pin 114 is equal to the length of the chip component 118. This distance is designated "L" in FIG. 14. It will be appreciated that this distance "L" can vary somewhat due to manufacturing tolerances of the chip components 118. The illustrated embodiment provides a self-compliant character to the assembly. This self-compliance is facilitated by the flexibility of the leaf spring 130 coupled with the tight tolerance relationship between its tail 131 and the engagement slot 129 which constrains movement of the tail 131 that fits snugly therewithin. Each pocket 126 and leaf spring 130 independently accommodate dimensional tolerance of components, while the overall unitary configuration of the spring plate 116 keeps assembly simple.

When desired, after terminal pins 114, chip components 118 and the unitary spring 116 are assembled into and onto the housing, recess 120 in mounting face 112*b* can be filled with a sealing encapsulant. The encapsulant is poured into the recess in liquid form and is allowed to cure and completely seal the entire mounting face of the connector through which the terminal pins, chip components and unitary spring were assembled. In addition, the encapsulent secures the ferrite to the housing throughout its life.

In a typical embodiment, a ferrite such as the one illustrated at 136 is positioned over the unitary spring member 116. A plurality of holes 138 provide access for the terminal pins 114 therethrough. Advantageously, the illustrated ferrite 136 substantially covers plate-like section 133 of the spring 116.

It can be seen from the foregoing that the fabrication or assembly of connector 110 is made quite simple by assembling terminals pins 114, chip components 118 and unitary spring member 116 into or onto the same face of the housing. This considerably simplifies the assembly tooling for the connector. The terminal pins can be assembled from either the mating face or the mounting face of the housing regardless of the orientation of the housing, because of the press-fit of the terminal pins into passages 124. Sealing the connector, when practiced, also is made quite simple in that the sealing encapsulant must simply fill one recess at one face of the connector to seal all of the passages/pockets/slots into which the components are assembled.

Figure 18:
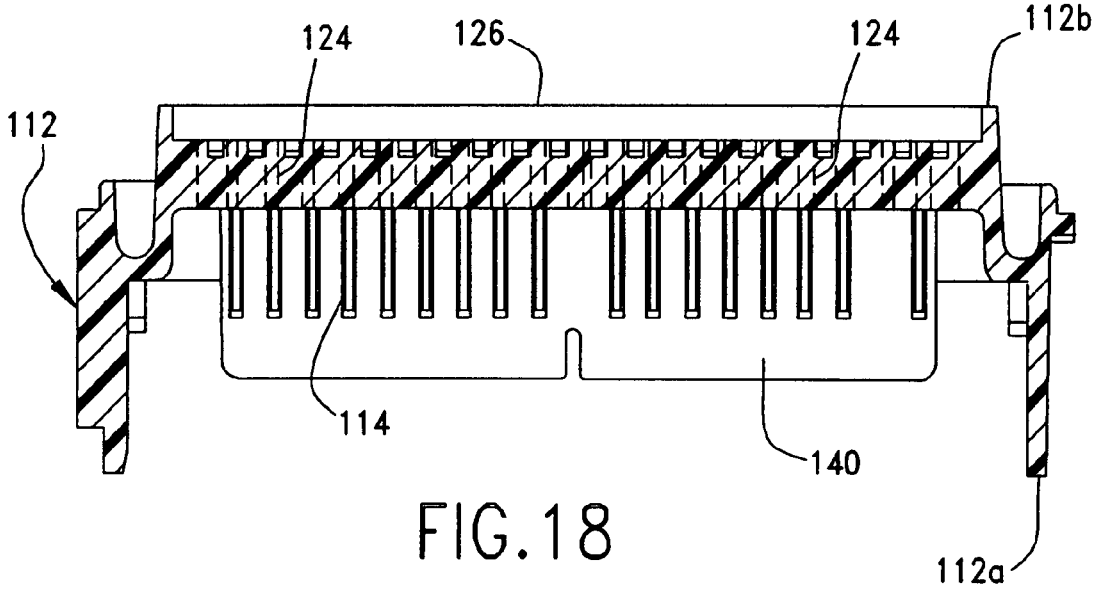
FIG. 18 is a longitudinal sectional view of FIG. 15.
Figure 21:
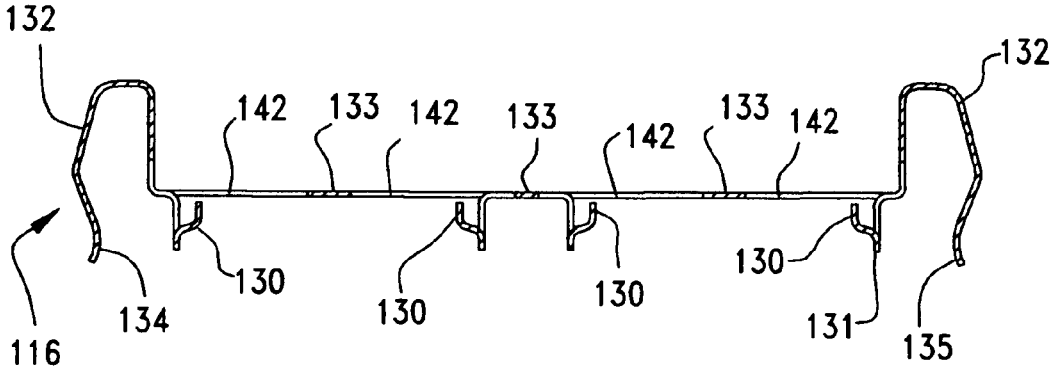
FIG. 21 is a transverse cross-sectional view of the unitary spring member shown in FIG. 19.
Figure 22:
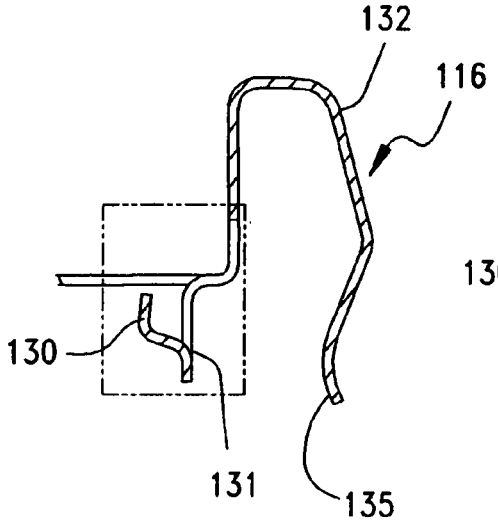
FIG. 22 is an enlarged, detailed view of the right-side end of the unitary spring member in FIG. 21.

FIG. 15 provides further details of a typical dielectric housing 112. This illustrates an 80-way shroud typical to accommodate 0.64 mm square pins. Further details are shown in FIGS. 16, 17 and 18. An anto-scoop fin 140 is illustrated. Typically, same is fabricated of dielectric material. FIG. 15 shows the dielectric housing 112 with the terminal pins omitted for illustrative purposes.

Figure 23:
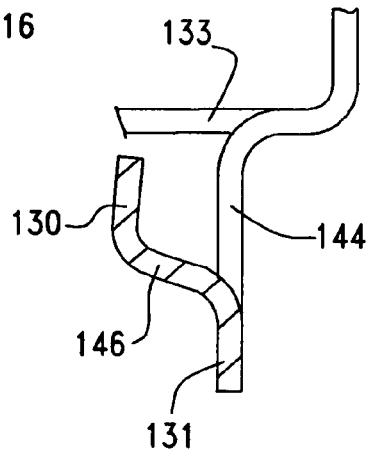
FIG. 23 is a further detailed view of a portion of the right side of the unitary spring member of FIG. 21.
Figure 19:
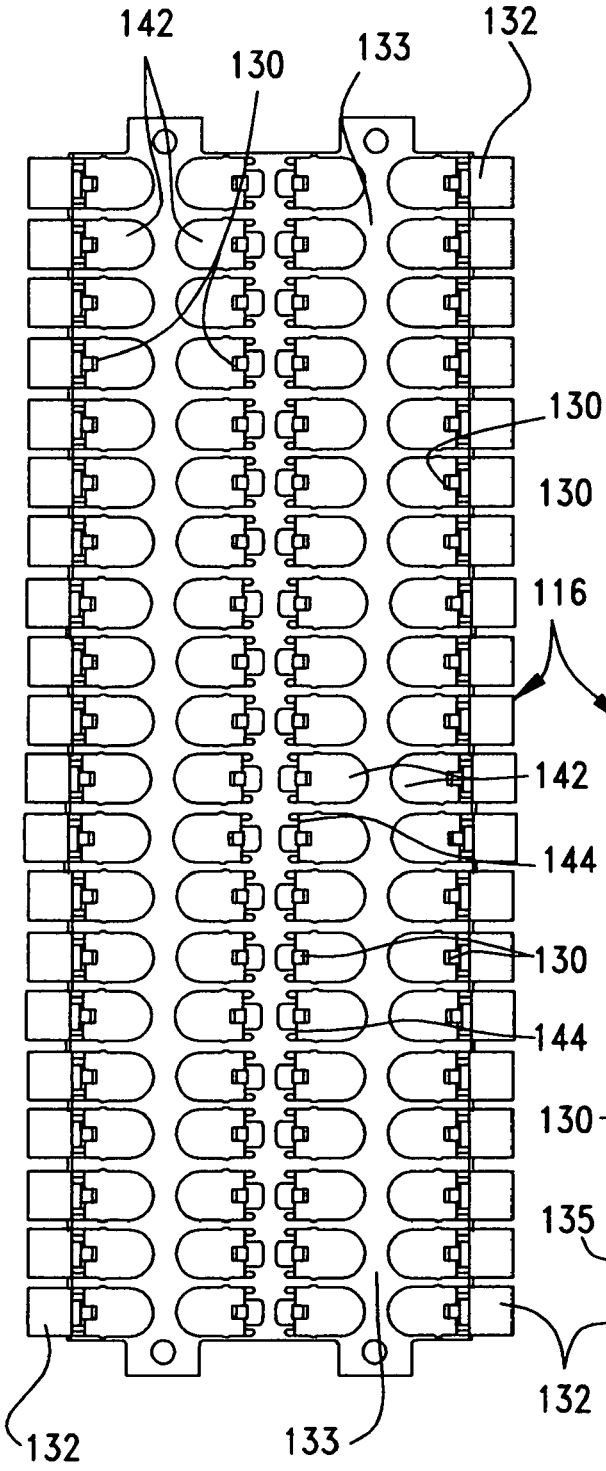
FIG. 19 is a top plan view of an embodiment of the unitary spring member from the mounting face side.
Figure 20:
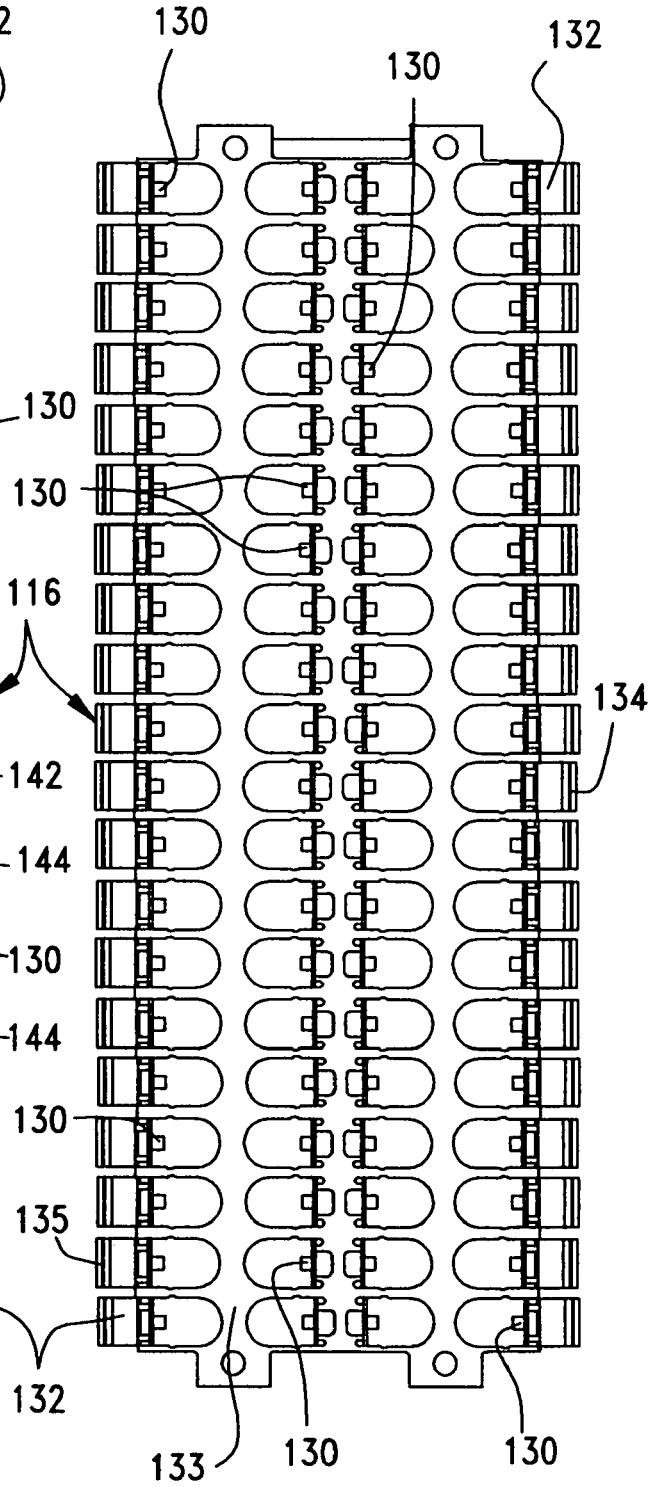
FIG. 20 is a bottom plan view of an embodiment of the unitary spring member, shown from the mating face side.

FIGS. 19, 20, 21, 22 and 23 illustrate a typical unitary spring member or common spring plate 116 suitable for use with a filter connector with the type discussed herein. Apertures 142 accommodate the respective terminal pins. In this illustrated embodiment, a leaf spring 130 is associated with each such aperture 142. As with other components, the apertures are shown arranged in four rows and twenty columns. Four such rows can be seen in FIG. 21. A typical illustrated arrangement between a leaf spring 130 and edge clip 132 can be seen in FIG. 22. FIG. 23 provides an enlarged view of the boxed-in portion of FIG. 22.

Leaf spring 130 is cantilevered from the plate-like section 133 in order to provide the required biasing force. Same can include a downwardly-depending strut 144 from which is mounted a non-linear engagement finger 146, shown in a generally S-shape in the various drawings. The non-linear engagement finger typically bridges a gap between opposing struts 144. It is convenient when unitary spring member 116 is formed by stamping that the downwardly depending struts 144 and the intermediate engagement fingers 146 are fashioned from material used in forming the apertures 142. As previously noted, each leaf spring includes a downwardly depending tail 131 that are used to locally align each leaf spring 130 with its engagement slot 129 and the housing pockets 126 with their respective chip components therewithin.

Figure 24:
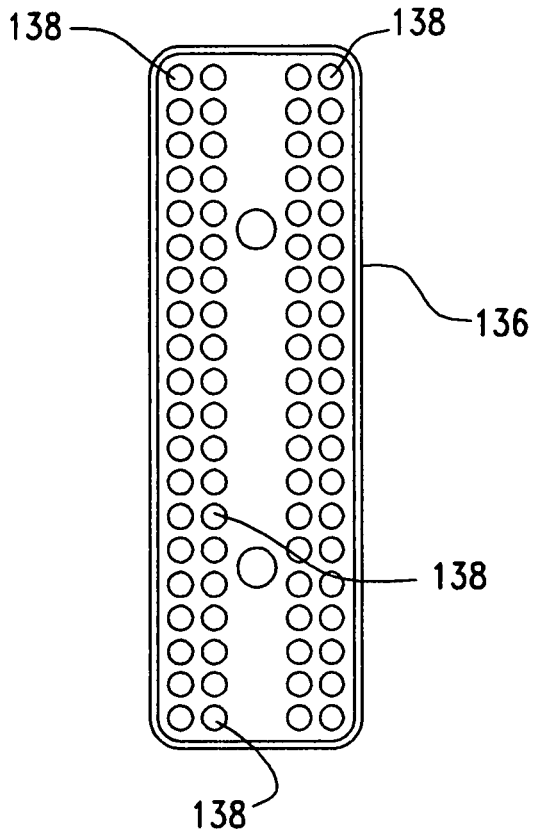
FIG. 24 is a top plan view of an embodiment of a ferrite member, showing the mounting face thereof.
Figure 25:
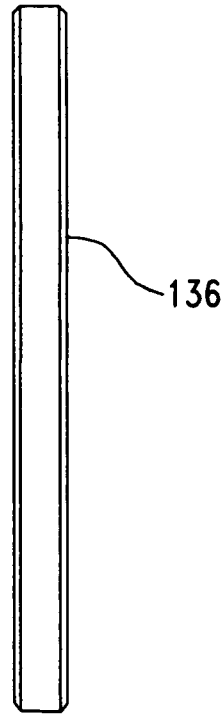
FIG. 25 is a longitudinal side elevational view of FIG. 24.
Figure 26:
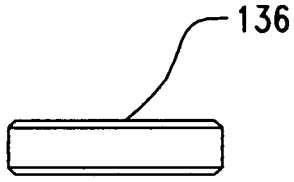
FIG. 26 is an end elevational view of FIG. 24.

FIGS. 24, 25 and 26 illustrate a typical ferrite 136. The particular embodiment illustrated in these figures is sized and shaped to overlie the terminal pin and capacitor matrix that is illustrated. It will be noted that the illustrated ferrite 136 includes four rows and twenty columns of through holes 138.

Figure 27:
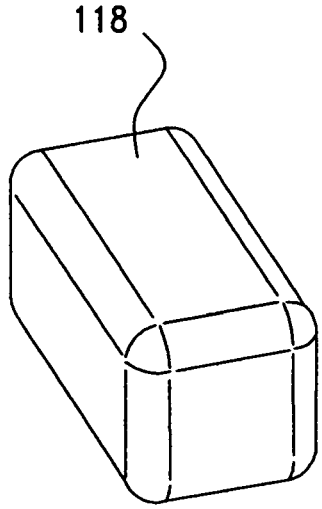
FIG. 27 is a perspective view of an embodiment of a filter member for use in the filter connector assembly.

FIG. 27 illustrates a typical chip component 118. The illustrated chip component is a multi-layered chip capacitor that is suitable for use when it is desired to provide capacitors for carrying out the filtering functions associated with a filter electrical connector. It will be appreciated that characteristics of the chip component 118 can be varied as desired. For example, the present approach allows filter connectors to be tailored to provide electronic characteristics that vary among the several pin circuits within an individual filter connector. This advantage is facilitated in part by the selection of standard-sized chip components, which can be configured on demand in the assembly process. Also, the self-compliant approach discussed herein accommodates differences among these standard-sized chip components, which are easily placed in the pockets and then properly positioned by operation of each respective leaf spring.

FIGS. 28 and 29 depict an embodiment having inner housing modules 156 in association with a unitary spring member and common spring plate 116. In this illustrated embodiment, there are twenty such inner housing modules 156. These inner housing modules are stacked next to each other in side-by-side engaging fashion and are inserted into a shell 158 of a dielectric housing 162. Housing 162 includes a mating face 162*a*, a mounting face 162*b*, and a plug portion 162*c* that is formed largely by the shell 158. With this approach, the edge clips or legs 132 of the unitary spring member 116 fit over the ribs or upstanding portion 164 of the plug portion 162*c*.

Each inner housing module 156 includes passages for the terminal pins 114 and pockets (not shown in FIG. 29) for the chip components 118. These pockets are on the order of pockets 30 that are shown in FIG. 3. A typical terminal receiving passage is illustrated at 174, and a typical engagement slot for receiving a downwardly depending tail 131 of a leaf spring of the unitary spring member or common spring plate 116 is illustrated at 176 in FIG. 29.

Figure 30:
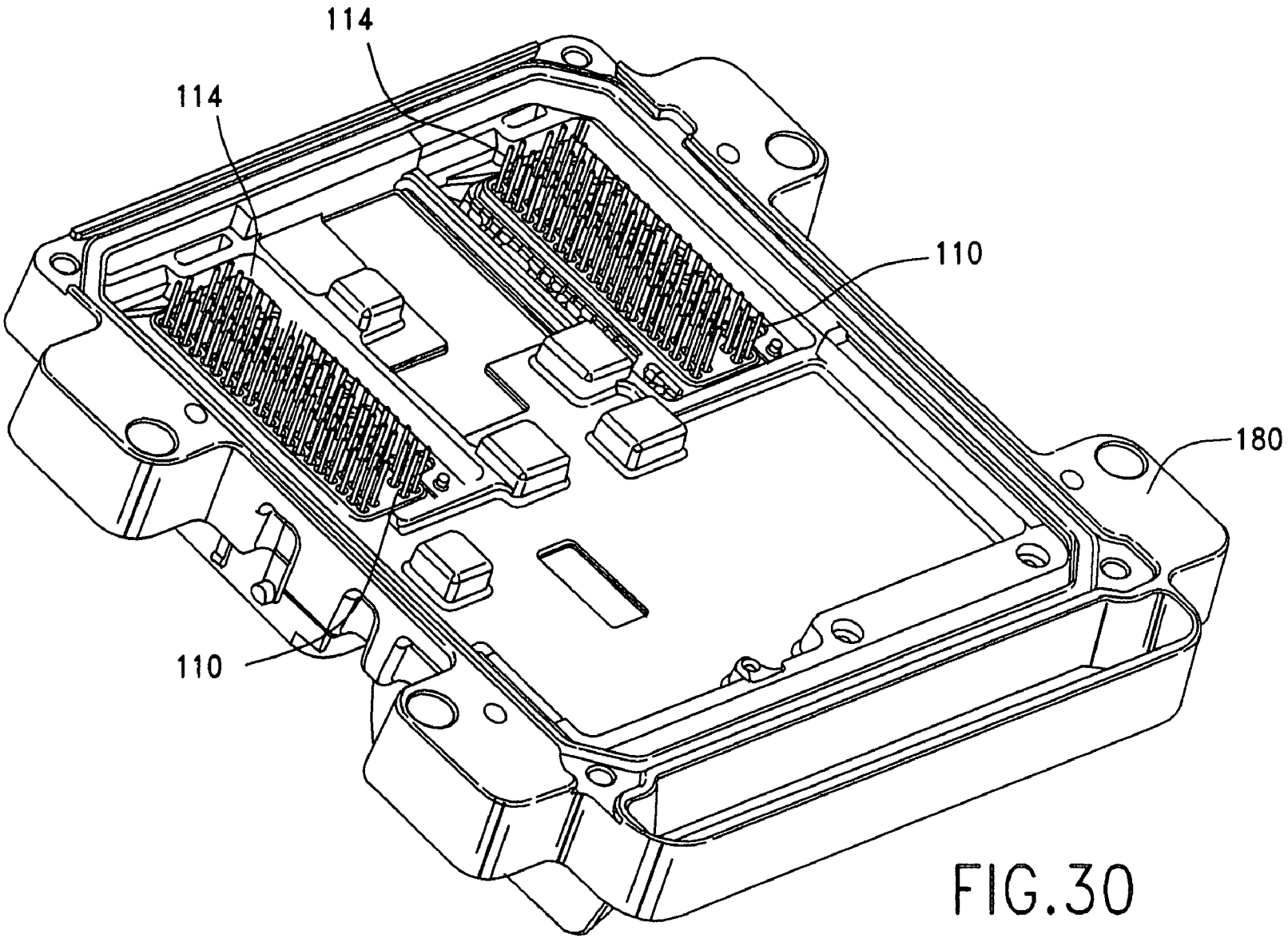
FIG. 30 is a perspective view of a typical control module header assembly including a typical die cast assembly including two filtered electrical connectors.

FIG. 30 illustrates an in-use application for filtered electrical connectors, shown at 110 in FIG. 30. These are mounted within a typical prior art module 180 that is mounted within a motorized vehicle, for example. A printed circuit board (not shown) engages the terminal pins 114 in a manner well known in the art, with the other ends of the terminal pins 114 being in engagement with contacts for providing electronic communication in a manner well known in the art.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein. Numerous modifications may be made without departing from the disclosure, including those combinations of features that are individually disclosed or claimed herein.

The invention claimed is:

1. An electrical filter connector, comprising:

a dielectric housing having a mounting face, said mounting face having opposing upstanding walls and at least one row of terminal-receiving passages in the housing through the mounting face;

at least one row of pockets in the housing in alignment with said passages, one side of each pocket communicating with its respective passage;

a unitary spring member positioned over said pockets and extending between said opposing upstanding walls of the dielectric housing, said unitary spring member including a plate-like section having edge clips at opposing edges thereof and having at least one row of terminal-receiving apertures therethrough respectively in alignment with said passages in the housing, said edged clips engaging said opposing upstanding walls of the dielectric housing;

a plurality of terminals extending through said apertures of the spring member and into said passages of the housing;

a plurality of chip components positioned within respective said pockets of the housing, said chip components having one side and an opposite side, with said one side of the chip components respectively engaged with the terminals; and a plurality of leaf springs of the spring member engaged with said opposite side of the chip components, said leaf springs respectively biasing said chip components between the respective leaf springs and their respective terminals.

2. A method of manufacturing an electrical filter connector, comprising:

providing a dielectric housing having a mounting face with a plug portion having at least one row of terminal-receiving passages therethrough and at least one row of pockets in alignment and communication with the respective passages;

inserting a plurality of terminals into respective terminal-receiving passages of the dielectric housing;

placing a plurality of chip components into respective pockets of the dielectric housing, each chip component having one side and an opposite side;

positioning a unitary spring member having a plurality of leaf springs having a tail and at least one row of terminal-receiving apertures therethrough over said pockets and chip components while passing the terminals through the unitary spring member apertures and inserting the tails of the respective leaf springs into slots of the dielectric housing; and biasing the chip components between the respective leaf springs of the unitary spring members and their respective terminals while the respective tails are held in place within the respective slots of the dielectric housing.

3. The filter connector according to claim 1, wherein columns are oriented generally orthogonal to said rows, each column including a plurality of each of said terminal-receiving passages, said pockets, said terminal-receiving apertures, terminals, chip components, leaf springs and edge clips.

4. The filter connector according to claim 1, wherein said leaf springs, plate-like section and edge clips of the unitary spring member are made from a single piece of metal, and said unitary spring member provides ground shielding over the dielectric housing within the opposing upstanding walls thereof.

5. An electrical filter connector, comprising:

a dielectric housing having a mounting face, said mounting face having opposing upstanding walls defining edges of a plug portion of the connector having a given width between respective outside surfaces of the opposing upstanding walls, and at least one row of terminal-receiving passages in the housing through the mounting face;

at least one row of pockets in the housing in alignment with said passages, one side of each pocket communicating with its respective passage;

a unitary spring member positioned over said pockets and extending between said opposing upstanding walls of the dielectric housing, said unitary spring member having at least one row of terminal-receiving apertures therethrough respectively in alignment with said passages in the housing and including opposing edge clips each with an inset portion, and wherein opposing inset portions are spaced apart by said given width;

a plurality of terminals extending through said apertures of the spring member and into said passages of the housing;

a plurality of chip components positioned within respective said pockets of the housing, said chip components having one side and an opposite side, with said one side of the chip components respectively engaged with the terminals; and a plurality of leaf springs of the spring member engaged with said opposite side of the chip components, said leaf springs respectively biasing said chip components between the respective leaf springs and their respective terminals.

6. The filter connector according to claim 1, wherein said chip components have a length that can vary from chip component to chip component, and said leaf spring exhibits a self-compliance characteristic whereby the leaf spring and its said opposing terminal are spaced apart by a distance that corresponds to said length of its particular chip component.

7. The filter connector according to claim 6, further including engagement slots in the dielectric housing, and said leaf springs have an extending tail received within a respective said engagement slot positioning said leaf spring said distance from said terminal that corresponds to the length of the chip component.

8. An electrical filter connector, comprising:

a dielectric housing having a mounting face, said mounting face having opposing upstanding walls and at least one row of terminal-receiving passages in the housing through the mounting face;

at least one row of pockets in the housing in alignment with said passages, one side of each pocket communicating with its respective passage;

a unitary spring member positioned over said pockets and extending between said opposing upstanding walls of the dielectric housing, said unitary spring member having at least one row of terminal-receiving apertures therethrough respectively in alignment with said passages in the housing;

a plurality of terminals extending through said apertures of the spring member and into said passages of the housing;

a plurality of chip components positioned within respective said pockets of the housing, said chip components having one side and an opposite side, with said one side of the chip components respectively engaged with the terminals;

a plurality of leaf springs of the spring member engaged with said opposite side of the chip components, said leaf springs respectively biasing said chip components between the respective leaf springs and their respective terminals; and a ferrite having a plurality of holes through which respective said terminals pass, said ferrite being positioned over said unitary spring member.

9. An electrical filter connector, comprising:

a dielectric housing having a mounting face and including a plurality of inner housing modules, said mounting face having opposing upstanding walls and at least one row of terminal-receiving passages in the housing through the mounting face;

at least one row of pockets in the housing in alignment with said passages, one side of each pocket communicating with its respective passage;

a unitary spring member positioned over said pockets and extending between said opposing upstanding walls of the dielectric housing. said unitary spring member having at least one row of terminal-receiving apertures therethrough respectively in alignment with said passages in the housing;

a plurality of terminals extending through said apertures of the spring member and into said passages of the housing;

a plurality of chip components positioned within respective said pockets of the housing, said chip components having one side and an opposite side, with said one side of the chip components respectively engaged with the terminals; and a plurality of leaf springs of the spring member engaged with said opposite side of the chip components, said leaf springs respectively biasing said chip components between the respective leaf springs and their respective terminals.

10. An electrical filter connector, comprising:

a dielectric housing having a mounting face, said mounting face having opposing upstanding walls and at least one row of terminal-receiving passages in the housing through the mounting face;

at least one row of pockets in the housing in alignment with said passages, one side of each pocket communicating with its respective passage;

a unitary spring member positioned over said pockets and extending between said opposing upstanding walls of the dielectric housing, said unitary spring member having at least one row of terminal-receiving apertures therethrough respectively in alignment with said passages in the housing;

a plurality of terminals extending through said apertures of the spring member and into said passages of the housing;

a plurality of chip components positioned within respective said pockets of the housing, said chip components having one side and an opposite side, with said one side of the chip components respectively engaged with the terminals; and a plurality of leaf springs of the spring member engaged with said opposite side of the chip components, said leaf springs respectively biasing said chip components between the respective leaf springs and their respective terminals, said leaf springs including a non-linear engagement finger and being cantilevered from at least one downwardly depending strut of the unitary spring member.

11. The filter connector according to claim 1, wherein said chip component is selected from the group consisting of filters, capacitors, resistors, jumpers and combinations thereof.

12. The filter connector according to claim 10, wherein said finger is generally S-shaped.

13. An electrical filter connector, comprising:

a dielectric housing having a mounting face, said mounting face having a plug portion and at least one row of terminal-receiving passages through the mounting face of the housing;

at least one row of pockets in the housing in alignment with said passages, one side of each pocket communicating with its respective terminal-receiving passage;

a unitary spring plate positioned over said pockets and extending over said plug portion of the dielectric housing, said unitary spring plate including a plate-like section having edge clips at opposing edges thereof and having at least one row of terminal-receiving apertures therethrough respectively in alignment with said passages in the housing, said edge clips engaging said plug portion of the dielectric housing;

a plurality of terminal pins extending through respective said apertures of the unitary spring plate and into respective said passages of the housing;

a plurality of capacitors positioned within respective said pockets of the housing, said capacitors having one side and an opposite side, with said one side respectively engaged with respective said terminals; and a leaf spring of the unitary spring plate engaged with respective said opposite sides of the capacitors, said leaf springs respectively biasing said capacitors between the respective leaf springs and their respective terminals.

14. An electrical filter connector, comprising:

a dielectric housing having a mounting face, said mounting face having a plug portion and at least one row of terminal-receiving passages through the mounting face of the housing;

at least one row of pockets in the housing in alignment with said passages, one side of each pocket communicating with its respective terminal-receiving passage;

a unitary spring plate positioned over said pockets and extending over said plug portion of the dielectric housing, said unitary spring plate having at least one row of terminal-receiving apertures therethrough respectively in alignment with said passages in the housing;

a plurality of terminal pins extending through respective said apertures of the unitary spring plate and into respective said passages of the housing;

a plurality of capacitors positioned within respective said pockets of the housing, said capacitors having one side and an opposite side, with said one side respectively engaged with respective said terminals; and a leaf spring of the unitary spring plate engaged with respective said opposite sides of the capacitors, said leaf springs respectively biasing said capacitors between the respective leaf spring and their respective terminals, said leaf springs each including a non-linear engagement finger, a tail downwardly depending therefrom and being cantilever-mounted from said unitary spring plate.

15. The filter connector according to claim 13, where in said leaf springs, plate-like section and edge clips of the unitary spring plate are made from a single piece of metal, and said unitary spring plate provides ground shielding over the plug portion of the dielectric housing.

16. The filter connector according to claim 13, wherein said capacitors are chip capacitors that have a length that varies from capacitor to capacitor, and said leaf spring exhibits a self-compliance characteristic whereby the leaf spring and its said opposing terminal are spaced apart by a distance that corresponds to said length of its particular chip capacitor.

17. An electrical filter connector, comprising:

a dielectric housing having a mounting face and including a plurality of inner housing modules, said mounting face having a plug portion and at least one row of terminal-receiving passages through the mounting face of the housing;

at least one row of pockets in the housing in alignment with said passages, one side of each pocket communicating with its respective terminal-receiving passage;

a unitary spring plate positioned over said pockets and extending over said plug portion of the dielectric housing, said unitary spring plate having at least one row of terminal-receiving apertures therethrough respectively in alignment with said passages in the housing;

a plurality of terminal pins extending through respective said apertures of the unitary spring plate and into respective said passages of the housing;

a plurality of capacitors positioned within respective said pockets of the housing, said capacitors having one side and an opposite side, with said one side respectively engaged with respective said terminals; and a leaf spring of the unitary spring plate engaged with respective said opposite sides of the capacitors, said leaf springs respectively biasing said capacitors between the respective leaf spring and their respective terminals.

* * * * *